US007704351B2

(12) United States Patent
Lipponen et al.

(10) Patent No.: US 7,704,351 B2
(45) Date of Patent: Apr. 27, 2010

(54) PROCESSING DEVICE AND METHOD OF OPERATING THE DEVICE FOR PROCESSING A COATED OR UNCOATED FIBROUS WEB

(75) Inventors: Juha Lipponen, Järvenpää (FI); Vilho Nissinen, Numminen (FI); Pekka Koivukunnas, Järvenpää (FI); Mika Viljanmaa, Helsinki (FI); Henri Vaittinen, Järvenpää (FI); Reijo Pietikäinen, Järvenpää (FI); Kari Hasanen, Kerava (FI); Risto Sutti, Tampere (FI); Eero Suomi, Hämeenlinna (FI); Pekka Linnonmaa, Järvenpää (FI); Markku Kyytsönen, Numminen (FI); Matti Tervonen, Hyvinkää (FI); Heikki Kettunen, Espoo (FI); Kari Holopainen, Muurame (FI)

(73) Assignee: Metso Paper, Inc., Helsinki (FI)

( * ) Notice: Subject to any disclaimer, the term of this patent is extended or adjusted under 35 U.S.C. 154(b) by 966 days.

(21) Appl. No.: 10/502,865

(22) PCT Filed: Jan. 29, 2003

(86) PCT No.: PCT/FI03/00066

§ 371 (c)(1),
(2), (4) Date: May 24, 2005

(87) PCT Pub. No.: WO03/064761

PCT Pub. Date: Aug. 7, 2003

(65) Prior Publication Data

US 2005/0251977 A1 Nov. 17, 2005

(30) Foreign Application Priority Data

| | | |
|---|---|---|
| Jan. 29, 2002 | (FI) | 20020159 |
| Jul. 12, 2002 | (FI) | 20021366 |
| Jul. 12, 2002 | (FI) | 20021367 |
| Jul. 12, 2002 | (FI) | 20021368 |

(51) Int. Cl.
*D21G 1/00* (2006.01)
*D21G 9/00* (2006.01)

(52) U.S. Cl. ..... 162/361; 162/358.1; 162/358.4; 162/362; 100/153; 100/156; 100/163 A; 100/164; 100/162 R; 100/168

(58) Field of Classification Search ..... 162/204–207, 162/358.1–358, 359.1, 360.1, 360.2, 361–362; 100/151, 153, 163 A, 164, 162 R, 35–38, 100/156, 168
See application file for complete search history.

(56) References Cited

U.S. PATENT DOCUMENTS 3,354,035 A 11/1967 Gottwald et al.

(Continued)

FOREIGN PATENT DOCUMENTS

DE 32 02 619 A1 10/1982

(Continued)

OTHER PUBLICATIONS

Fister, Frank, "Theoretical and constructional investigation of use of the wide-nip concept in an experimental calendar"—Dissertation, Aug. 31, 1992, pp. 1-121.

*Primary Examiner*—José A Fortuna
(74) *Attorney, Agent, or Firm*—Alston & Bird LLP

(57) ABSTRACT

A processing device and method applying the same for processing a coated or uncoated fibrous web is provided. The device comprises a belt configured to extend around a guiding element, at least one counter-element being disposed outside said belt to provide a contact area with the belt, such that the belt and the counter-element establish therebetween a web processing zone for passing a web to be processed therethrough. The processing zone length is defined by the disposition of the belt's guiding element and/or by the configuration of the counter-elements. The contact pressure applied to a web in the processing zone is within the range of between about 0.01 MPa and about 200 MPa.

15 Claims, 18 Drawing Sheets

U.S. PATENT DOCUMENTS

| | | | | | |
|---|---|---|---|---|---|
| 3,647,619 | A | * | 3/1972 | Mack et al. | 162/206 |
| 4,461,095 | A | | 7/1984 | Lehtinen | |
| 4,657,807 | A | * | 4/1987 | Fuerstman | 442/230 |
| 4,704,191 | A | * | 11/1987 | Wedel | 162/358.3 |
| 4,738,752 | A | | 4/1988 | Busker et al. | |
| 4,880,502 | A | | 11/1989 | Wedel | |
| 4,887,329 | A | | 12/1989 | Perneczky | |
| 4,976,820 | A | * | 12/1990 | Laapotti | 162/206 |
| 5,015,303 | A | | 5/1991 | Perneczky | |
| 5,255,447 | A | * | 10/1993 | Christ | 34/114 |
| 5,389,205 | A | * | 2/1995 | Pajula et al. | 162/205 |
| 5,483,873 | A | | 1/1996 | Koivukunnas et al. | |
| 5,594,997 | A | | 1/1997 | Lehtinen | |
| 5,599,585 | A | * | 2/1997 | Cohen | 427/250 |
| 5,611,893 | A | | 3/1997 | Pajula et al. | |
| 5,614,063 | A | * | 3/1997 | Graf et al. | 162/263 |
| 5,649,448 | A | * | 7/1997 | Koskimies et al. | 73/159 |
| 5,722,182 | A | | 3/1998 | Lehtinen et al. | |
| 5,843,283 | A | | 12/1998 | Henssler et al. | |
| 5,983,787 | A | | 11/1999 | Linsuri et al. | |
| 6,024,838 | A | * | 2/2000 | Van Haag et al. | 162/361 |
| 6,182,564 | B1 | * | 2/2001 | Gwosdz-Kaupmann | 100/38 |
| 6,314,659 | B1 | | 11/2001 | Parker | |
| 6,397,739 | B1 | * | 6/2002 | Viljanmaa | 100/38 |
| 6,418,840 | B1 | * | 7/2002 | Viljanmaa | 100/38 |
| 6,582,561 | B2 | * | 6/2003 | Bernhard | 162/358.5 |
| 6,701,637 | B2 | * | 3/2004 | Lindsay et al. | 34/71 |
| 6,827,009 | B2 | * | 12/2004 | Koivukunnas et al. | 100/35 |
| 6,994,771 | B1 | * | 2/2006 | Korhonen et al. | 162/202 |
| 7,000,536 | B2 | * | 2/2006 | Laitila et al. | 100/153 |
| 2002/0152630 | A1 | * | 10/2002 | Lindsay et al. | 34/111 |
| 2003/0024672 | A1 | * | 2/2003 | Viljanmaa et al. | 162/194 |
| 2003/0034140 | A1 | * | 2/2003 | Bernhard | 162/358.3 |
| 2004/0035302 | A1 | * | 2/2004 | Laitila et al. | 100/153 |
| 2004/0101704 | A1 | * | 5/2004 | Hermans et al. | 428/535 |
| 2005/0251976 | A1 | * | 11/2005 | Lipponen et al. | 28/100 |
| 2005/0251977 | A1 | * | 11/2005 | Lipponen et al. | 28/100 |
| 2006/0060322 | A1 | * | 3/2006 | Viljanmaa et al. | 162/206 |
| 2008/0295987 | A1 | * | 12/2008 | Pietikainen et al. | 162/197 |

FOREIGN PATENT DOCUMENTS

| | | | | |
|---|---|---|---|---|
| DE | 41 38 789 | A1 | | 5/1993 |
| DE | 199 46 982 | A1 | | 4/2001 |
| DE | 100 17 803 | A1 | | 1/2002 |
| EP | 0 328 844 | A1 | | 8/1989 |
| EP | 0 870 870 | A2 | | 10/1998 |
| FI | 843895 | | | 4/1986 |
| FI | 84739 | | | 11/1989 |
| WO | WO 97/44524 | | | 11/1997 |
| WO | WO 98/44196 | A1 | | 10/1998 |
| WO | WO 01/75223 | A1 | | 10/2001 |
| WO | WO 0183884 | A1 | * | 11/2001 |
| WO | WO 01/98585 | A1 | | 12/2001 |
| WO | WO 03064761 | A1 | * | 8/2003 |
| WO | WO 03064762 | A1 | * | 8/2003 |
| WO | WO 03064764 | A1 | * | 8/2003 |
| WO | WO 2004079091 | A1 | * | 9/2004 |
| WO | WO 2005049918 | A1 | * | 6/2005 |
| WO | WO 2005056921 | A1 | * | 6/2005 |
| WO | WO 2006003263 | A1 | * | 1/2006 |
| WO | WO 2007128867 | A1 | * | 11/2007 |
| WO | WO 2007141377 | A1 | * | 12/2007 |

* cited by examiner

PROCESSING DEVICE AND METHOD OF OPERATING THE DEVICE FOR PROCESSING A COATED OR UNCOATED FIBROUS WEB

BACKGROUND OF THE INVENTION

1. Field of the Invention

The present invention relates to a processing device and a method of operating the device for processing a coated or uncoated fibrous web, such as e.g. paper, board or tissue, comprising a belt adapted to extend around at least one guiding element, at least one counter-element being disposed outside said belt to provide a contact area with the belt, such that the belt and the counter-element establish therebetween a web processing zone for passing a web to be processed therethrough. In the concept of this application, the term 'web processing' refers to a variety of measures associated with the treatment of a fibrous web produced in a paper/board machine, such as pressing, drying, calendering, coating, sizing. The processing device may also be a finishing device for a fibrous web, such as e.g. a separate coating device, a printing device or a calender.

2. Description of Related Art

Various belt calender solutions have been disclosed previously e.g. in Finnish patent 95061, as well as in Finnish patent applications FI 971343 and FI 20001025. However, these belt calenders are only suitable for calendering certain grades of paper or board.

Paper and board are available in a wide variety of types and can be divided according to basis weight in two grades: papers with a single ply and a basis weight of 25-300 g/m$^2$ and boards manufactured in multi-ply technology and having a basis weight of 150-600 g/m$^2$. It should be noted that the borderline between paper and board is flexible since board grades with lightest basis weights are lighter than the heaviest paper grades. Generally speaking, paper is used for printing and board for packaging.

The subsequent descriptions are examples of values presently applied for fibrous webs, and there may be considerable fluctuations from the disclosed values. The descriptions are mainly based on the source publication Papermaking Science and Technology, section Papermaking Part 3, edited by Jokio, M., published by Fapet Oy, Jyväskylä 1999, 361 pages.

Mechanical-pulp based, i.e. wood-containing printing papers include newsprint, uncoated magazine and coated magazine paper.

Newsprint is composed either completely of mechanical pulp or may contain some bleached softwood pulp (0-15%) and/or recycled fiber to replace some of the mechanical pulp. General values for newsprint can probably be regarded as follows: basis weight 40-48.8 g/m$^2$, ash content (SCAN-P 5:63) 0-20%, PPS s10 roughness (SCAN-P 76-95) 3.0-4.5 μm, Bendtsen roughness (SCAN-P 21:67) 100-200 ml/min, density 600-750 kg/m$^3$, brightness (ISO 2470:1999) 57-63%, and opacity (ISO 2470:1998) 90-96%.

Uncoated magazine paper (SC=supercalendered) usually contains mechanical pulp to 50-70%, bleached softwood pulp to 10-25%, and fillers to 15-30%. Typical values for calendered SC paper (containing e.g. SC-C, SC-B, and SC-A/A+) include basis weight 40-60 g/m$^2$, ash content (SCAN-P 5:63) 0-35%, Hunter gloss (ISO/DIS 8254/1) <20-50%, PPS s10 roughness (SCAN-P 76:95) 1.0-2.5 μm, density 700-1250 kg/m$^3$, brightness (ISO 2470:1999) 62-70%, and opacity (ISO 2470:1998) 90-95%.

Coated magazine paper (LWC=light weight coated) contains mechanical pulp to 40-60%, bleached softwood pulp to 25-40%, and fillers and coaters to 20-35%. General values for LWC paper can be regarded as follows: basis weight 40-70 g/m$^2$, Hunter gloss 50-65%, PPS s10 roughness 0.8-1.5 μm (offset) and 0.6-1.0 μm (roto), density 1100-1250 kg/m$^3$, brightness 70-75%, and opacity 89-94%.

General values for MFC paper (machine finished coated) can be regarded as follows: basis weight 50-70 g/m$^2$, Hunter gloss 25-70%, PPS s10 roughness 2.2-2.8 μm, density 900-950 kg/m$^3$, brightness 70-75%, and opacity 91-95%.

General values for FCO paper (film coated offset) can be regarded as follows: basis weight 40-70 g/m$^2$, Hunter gloss 45-55%, PPS s10 roughness 1.5-2.0 μm, density 1000-1050 kg/m$^3$, brightness 70-75%, and opacity 91-95%.

General values for MWC paper (medium weight coated) can be regarded as follows: basis weight 70-90 g/m$^2$, Hunter gloss 65-75%, PPS s10 roughness 0.6-1.0 μm, density 1150-1250 kg/m$^3$, brightness 70-75%, and opacity 89-94%.

HWC (heavy weight coated) has a basis weight of 100-135 g/m$^2$ and can be coated even more than twice.

Pulp-produced, woodfree printing papers or fine papers include uncoated—and coated—pulp-based printing papers, in which the portion of mechanical pulp is less than 10%.

Uncoated pulp-based printing papers (WFU) contains bleached birchwood pulp to 55-80%, bleached softwood pulp to 0-30%, and fillers to 10-30%. The values with WFU are highly unstable: basis weight 50-90 g/m$^2$ (up to 240 g/m$^2$), Bendtsen roughness 250-400 ml/min, brightness 86-92%, and opacity 83-98%.

In coated pulp-based printing papers (WFC), the amounts of coating vary widely in accordance with requirements and intended application. The following are typical values for once- and twice-coated, pulp-based printing paper: once-coated basis weight 90 g/m$^2$, Hunter gloss 65-80%, PPS s10 roughness 0.75-2.2 μm, brightness 80-88%, and opacity 91-94%, and twice-coated basis weight 130 g/m$^2$, Hunter gloss 70-80%, PPS s10 roughness 0.65-0.95 μm, brightness 83-90%, and opacity 95-97%.

Release papers have a basis weight within the range of 25-150 g/m$^2$.

Other papers include e.g. sackkraft papers, tissues, and wallpaper bases.

Board making makes use of chemical pulp, mechanical pulp and/or recycled pulp. Boards can be divided e.g. in the following main groups according to applications thereof.

Corrugated board, comprising a liner and a fluting.

Boxboards, used for making boxes, cases. Boxboards include e.g. liquid packaging boards (FBB=folding boxboard, LPB=liquid packaging board, WLC=white-lined chipboard, SBS=solid bleached sulphite, SUS=solid unbleached sulphite).

Graphic boards, used for making e.g. cards, files, folders, cases, covers, etc.

Wallpaper bases.

SUMMARY OF THE INVENTION

As can be appreciated from the above, there is a wide range of paper and board grades, and a multitude of various machines are used for making the same. It is an object of the present invention to provide a processing device and a method of operating the same, allowing the use of a highly extensive pressure range and application time (heat transfer time and/or processing time) in a processing zone, the same device being applicable for processing a wide variety of coated and uncoated printing papers, boards and other papers, and being applicable e.g. as a preliminary calender upstream of coating, a finishing calender downstream of a paper machine or coating, a breaker stack, a wet stack calender, or as a dryer, a coater, a sizer, a printer and/or a press. The inventive device is conceivable as a replacement e.g. for a soft calender, a multi-nip calender, a machine calender, a shoe calender, or a Yankee cylinder.

In order to fulfil the objects of the invention, a device of the invention is characterized in that the processing zone length is defined by means of the disposition/adjustment of the belt's guiding element and/or by means of the design of the counter-elements, and that the contact pressure applied to a web in the processing zone is adapted to be adjustable within the range of about 0.01 MPa to about 200 MPa.

On the other hand, a method of the invention for processing a coated or uncoated fibrous web with a processing device is characterized in that the method comprises defining the processing zone length by means of the disposition/adjustment of the belt's guiding element and/or by means of the design of the counter-element, and that the method comprises adjusting a contact pressure existing in the processing zone to lie within the range of about 0.01 MPa to about 200 MPa.

Contact pressure refers to the sum of pressure effects applied to a web within a processing zone between a belt and a counter-element, which are caused by a tension of the belt and/or by a compression force applied by possible intra-belt press elements. The pressure adjustment of a contact pressure to a certain pressure value or pressure range is effected by choosing a suitable belt material, which allows the use of a desired tightness or tension, and, if necessary, suitable press elements capable of increasing pressure over what is achieved by the belt alone. It should be noted that, depending on an assembly made up by belt and counter-elements as well as possible press elements, it is possible to cover either a part of the contact pressure adjustment range, the transition to another pressure value or pressure range being effected by replacing, if necessary, some of the elements included in the assembly, or to cover, with a suitable assembly, the entire contact pressure adjustment range, which can be e.g. from about 0.01 MPa to about 70 MPa or even from about 0.01 MPa to about 200 MPa. For example, the compression achieved by belt tension alone is remarkably insignificant when compared to the compression accomplished with press elements, whereby, in the solutions implemented without press elements, the adjustment range lies closer to a lower limit, e.g. within the range of about 0.01 MPa to about 5 MPa. When using press elements, the adjustment range can be e.g. from about 5 MPa to about 70 MPa, preferably from about 7 MPa to about 50 MPa or e.g. from about 70 MPa to about 200 MPa.

A device according to one aspect of the invention is characterized in that the processing zone length is defined by means of the disposition/adjustment of the belt's guiding element and/or by means of the design of the counter-elements, and that the contact pressure adapted to be applied to a web within the processing zone is adapted to be adjustable within the range of about 0.01 MPa to about 200 MPa, that the belt comprises a metal or composite metal belt, and that the metal belt's operating temperature is adapted to be adjustable within the range of about 50° C. to about 400° C.

The inventive device comprises preferably a calender, a coater, a sizer, a printer, a dryer, a web cooler, and/or a press. According to the invention, a number of the above devices can be set successively in line, the sequence being for example a press device, a drying device, a calender, web cooling.

One object of the invention is to provide a method for quickly switching a grade of coated or uncoated paper, board or tissue to be calendered in a belt calender from one grade to another. The method is implemented by means of a belt calender, comprising a calendering belt adapted to extend around guiding elements, at least one counter-element being disposed outside said calendering belt to provide a contact area with the belt, such that the calendering belt and the counter-element establish therebetween a calendering zone for passing a web to be calendered therethrough. The method is characterized in that the calendering belt used in the method comprises a metal belt provided with heating means and/or cooling means for quickly changing the belt temperature, and that the change of temperature applied to the web is essentially performed only by adjusting the temperature of the metal belt.

On the other hand, a method according to one aspect of the invention for processing a coated or uncoated fibrous web in a fibrous web processing zone is characterized in that the method comprises defining the processing zone length by means of the disposition/adjustment of the belt guiding element and/or by means of the design of the counter-element, and that the method comprises adjusting a contact pressure existing in the processing zone to lie within the range of about 0.01 MPa to about 200 MPa, that the employed belt comprises a metal belt, and that the metal belt operating temperature is adjusted within the range of about 50° C. to about 400° C. The present invention relates further to a mechanism for the adjustment of a belt-tension inflicted compression force in a device for processing a coated or uncoated fibrous web, said processing device comprising a press belt adapted to extend around at least one guiding element, at least one counter-element being disposed outside said press belt loop to provide a contact area with the press belt, such that the press belt and the counter-element establish therebetween a web processing zone for passing a web to be processed therethrough. One object of the invention is a method for the adjustment of a belt-tension inflicted compression force in a device for processing a coated or uncoated fibrous web. In addition to a belt-tension adjustment mechanism, the processing device can also be provided with press elements inside the innermost belt loop for pressing the belt against the counter-element to establish a higher-pressure zone within the processing zone.

A mechanism according to this embodiment of the invention is characterized in that the compression-force adjustment mechanism comprises at least one backing belt loop, fitted inside the press belt of the processing device and including a backing belt adapted to extend around guiding elements, said backing belt squeezing the press belt in the region of the processing zone against the counter-element, whereby a web, on its way through the processing zone, is exposed to a cumulative contact pressure of compression forces caused by the tensions of the press belt and said at least one backing surface.

On the other hand, a method of the invention for the adjustment of a belt-tension inflicted compression force is characterized in that the method comprises the use of a processing device provided with at least two belt loops one inside the other, the outer one comprising said press belt and the inner one/ones the backing belt, and that the method comprises the independent adjustment for the tension and passage of the press belt and backing belt(s) for exposing within a processing zone a fibrous web passing across the processing zone to a cumulative contact pressure from compression forces generated by tension of the belts.

One further object of the invention is to provide a method for heating a belt, wherein heat transfer to the belt occurs economically and at a high efficiency. In one solution of the present invention, heating is effected conductively, i.e. a metallic belt is supplied with a powerful electric current. Thus, the belt constitutes part of a closed circuit. Since, as commonly known, because of electrical resistance, the electric current causes heating in the conductors of a circuit, the belt will also heat up. By appropriate selection of electric conductors, contactors as well as a metal belt, as well as a supply voltage, the belt can be subjected to powerful heating while other components of the circuit heat up only slightly. The electric current can be supplied to the belt, for example by way of a metallic backing roll. The rolls can be supplied with current, for example by means of a carbon contactor. In order to prevent the heating of supply conductors themselves, such conductors must be made of a material, e.g. copper, having an electrical conductivity higher than that of the belt. An advantage of the solution is a high efficiency. In one solution of the invention, the heating is performed by means of a liquid-gas, natural-gas or electrically operated infrared radiator. In yet another solution of the invention, the belt heating is effected indirectly as a contact heat transfer by way of at least one roll. The roll can be heated by any conventional heating method, preferably from inside with water, steam, oil, or internal combustion.

One object of the present invention is an on-line or off-line apparatus for regulating and profiling the loading and/or temperature of a processing device intended for processing a coated or uncoated fibrous web, such as e.g. paper, board, or soft tissue, said processing device comprising a belt adapted to extend around at least one guiding element, at least one counter-element being disposed outside said belt to provide a contact area or surface with the belt, such that the belt and the counter-element establish therebetween a web processing zone for passing a web to be processed therethrough.

Another object of the invention is a method for regulating and profiling the loading and/or temperature of a processing device intended for processing a coated or uncoated fibrous web, said processing device comprising a belt adapted to extend around a guiding element, at least one counter-element being disposed outside said belt to provide a contact area with the belt, such that the belt and the counter-element establish therebetween a processing zone for passing a web to be processed therethrough.

It is one objective of the present invention to provide a solution, which enables a highly accurate management or control over the operation, especially the regulation and crosswise (CD-directed) profiling of loading and/or temperature, of belt-calender type processing devices for a fibrous web.

In order to fulfil these objectives, a device of the invention is characterized in that the apparatus comprises means for adjusting the lateral distribution of belt tension. A device of the invention is also characterized in that the apparatus comprises means for regulating the belt temperature profile in lateral direction.

A method of the invention is, in turn, characterized in that the method comprises adjusting the lateral distribution of a belt tension and/or temperature.

The regulation of a lateral tension and/or temperature distribution in a belt provides an impact on the distribution of a contact pressure and contact temperature created within the processing zone, and thereby on the properties of a presently processed web.

Another object of the present invention is the use of a processing device of the invention for the management of a fibrous web regarding its moisture and thickness profile. The inventive processing device is also good for the management or control of a roughness profile and/or a gloss profile.

Notwithstanding the grade of paper or board, the dryer section has often an uneven moisture profile. Generally speaking, the moisture profile must be uniform prior to calendering for a good calendering result. For example, in on-line calendering of SC paper, the paper is overdried to about 4% prior to calendering for obtaining a uniform- or even-moisture profile. The dry paper web is re-moistened with on-line moisteners, typically to more than 10%. In terms of energy economy, the overdrying and re-moistening is a very expensive process.

The use of a metal belt calender designed according to the invention and the regulation of its temperature and loading profile enable the establishment of a uniform moisture and thickness profile. The moisture profile can be controlled solely by means of temperature. The nip load has no effect on moisture, or the effect of a nip load is highly insignificant. The thickness profile is controlled by the combined effect of temperature, moisture, and loading profiles.

The adjustment of moisture profile is performed by having points of pronounced moisture profiled with a higher temperature for providing a desired final moisture. Drier points are respectively provided with lower temperatures. The appropriate profiling of temperature provides a uniform moisture profile.

The adjustment of thickness profile requires a separately profiled loading device. In the process of adjusting the loading, it is necessary to consider also the moisture of paper and the temperature of a thermo roll. Moist and warm paper calenders more easily than dry and cold one. The appropriate profiling of a nip load provides a uniform thickness profile.

One exemplified assembly required for moisture and thickness profiling is composed of a metal belt calender provided with a long nip, 30-3000 mm, said nip being favourable for drying and calendering, a device useful for profiling the temperature of a thermo roll and/or metal belt in a cd-direction, e.g. a profiling induction, a device useful for profiling a nip load or pressure in a cd-direction, e.g. a sym roll, a moisture profile measuring device positioned downstream of at least the metal belt calender, and instruments for measuring a thickness profile downstream of the metal belt calender. The apparatus may possibly include also a roughness and/or gloss profile measuring feature, if the profiling of such properties is desired.

Table 1 discloses how various combinations of moisture, temperature, and nip load have been used to provide an equal final moisture and thickness in calendering LWC base paper. The values are based on results from trial runs.

TABLE 1

Nip time has been 200 ms. The base paper has had a basis weight of 38 g/m$^2$.

| BASE PAPER | | METAL BELT CALENDER | | CALENDERED PAPER | |
|---|---|---|---|---|---|
| | | thermo roll | nip | | |
| moisture | Thickness | temperature | pressure | moisture | thickness |
| 4.2% | 70 μm | 100° C. | 60 kN/m | 3.5% | 56 μm |
| 6.4% | 70 μm | 150° C. | 15 kN/m | 3.5% | 56 μm |
| 8.6% | 70 μm | 200° C. | 8 kN/m | 3.5% | 56 μm |

The method can be applied for most, and even all grades of paper and board.

By using a metal belt calender designed according to the invention, the adjustment of a moisture and thickness profile is implemented with a single mechanism, a uniform drying profile is obtained without overdrying, and machine and soft calendering, if present downstream of the dryer section, can be replaced. In addition, a metal belt calender provides a possibility of reaching a sufficient smoothness level.

The inventive processing device provides also other benefits, e.g. as follows:

- a supported web passage for a better runnability than in prior art solutions
- a capability of treating both sides of a web in a single nip
- a drying potential for a chance to replace a portion of the dryer section or to increase the speed of a paper machine (a single nip enables drying of paper from 13% to 6%, with thermo roll temperature of 200° C. and contact time of 40 ms with a metal belt)
- provides higher strengths than a machine calender
- provides a good large-scale smoothness as compared to a machine calender or soft calender (low Bendtsen roughness).

The above proposal concerns a processing device based on a belt-like press element for processing a fibrous web on a paper or board production line in several process steps. Suggested applications for the device include e.g. wet pressing, drying, surface and stock sizing, laminating, and calendering processes for a web. In a particularly preferred case, the suggested processes are implemented by means of a solution based on an endless metal belt. A common feature for most of the above embodiments is that the endless metal belt is heated, typically to about 100-250° C. However, an open, heated belt, running at a high speed, delivers heat very effectively around itself with a possible adverse impact on the energy efficiency and economy of the system.

The surface of an endless metal belt can probably be estimated to have a heat transfer coefficient of about 40-60 $W/m^2K$ at relevant running speeds. Supposing that the endless belt loop has a length of 10 m, which is a realistic estimate for a production machine, the evaporating area will be about 20 $m^2$ per meter in lateral direction. Supposing that the surrounding temperature is 50° C., the belt temperatures of 150-200° C. result in estimated thermal loss rates of 80-180 kW/m. Although highly simplified, the calculation nevertheless indicates the order of magnitude and the fact that heat losses from the belt can be highly significant unless the belt is somehow protected.

Thus, it is an object of the invention to provide a solution, which enables minimization of heat losses in a processing device of the invention provided with a heated metal belt.

In order to fulfil this objective, a processing device of the invention for processing a coated or uncoated fibrous web, said device comprising a heatable metal belt adapted to extend around at least one guiding element, at least one counter-element being disposed outside said belt to provide a contact area with the belt, such that the belt and the counter-element establish therebetween a web processing zone for passing a web to be processed therethrough, is characterized in that the metal belt has its belt loop adapted to travel in an enclosed or sealed space for minimizing convective heat losses.

One way of implementing the inventive solution is e.g. to place the belt loop either completely or partially inside a hood. Said hood can be designed to simultaneously function as a shield in eventual damage situations.

BRIEF DESCRIPTION OF THE SEVERAL VIEWS OF THE DRAWING(S)

The invention and its various applications will now be described in more detail with reference to the accompanying drawings, in which:

| | |
|---|---|
| FIG. 1 | shows in a schematic side view one exemplary embodiment for a device of the invention, the only elements depicted being those necessary for understanding the invention, |
| FIG. 1b | shows in a schematic side view one variant for the device of FIG. 1, |
| FIG. 2 | shows in a schematic side view a second embodiment for a device of the invention, |
| FIGS. 3-7 | illustrate a few optional implementations for the invention, |
| FIG. 8 | shows in a schematic side view one embodiment for a mechanism of the invention for regulating a compression force caused by a belt tension, |
| FIG. 9 | shows one way of implementing a backing belt used in the invention, |
| FIG. 10 | shows in a schematic side view yet another exemplary embodiment for a device of the invention; |
| FIG. 11 | shows in a schematic side view still another exemplary embodiment for a device of the invention; |
| FIG. 12 | shows in a schematic side view yet another exemplary embodiment for a device of the invention; |
| FIG. 13 | shows in a schematic side view a further exemplary embodiment for a device of the invention; |
| FIG. 14 | shows in a schematic side view one variant for the device of FIG. 10, |
| FIG. 15 | shows in a schematic side view a still further exemplary embodiment for a device of the invention, |
| FIG. 16 | shows in a schematic side view a yet further exemplary embodiment for a device of the invention, |
| FIGS. 17-21 | are schematic views, depicting lateral profiling for the belt temperature, |
| FIG. 22 | is an elevation, depicting a view of one pilot machine designed according to the invention, |
| FIG. 23 | shows the pilot machine of FIG. 22 in a plan view, |
| FIG. 24 | shows in a flow chart one embodiment for positional adjustment of a belt calender, |
| FIG. 25 | shows schematically one implementation for an LWC-paper production line, |
| FIGS. 26-29 | show schematically a few embodiments for a device of the invention, comprising means for minimizing heat transfer to atmosphere. |

DETAILED DESCRIPTION OF THE INVENTION

In reference to FIG. 1, there is shown one processing device of the invention, implemented as a belt calender which comprises a metal-constructed calender belt 2 extending around guiding rolls 3, at least some of said guiding rolls being displaceable for adjusting the belt 2 to a desired tension or tightness. The calendering belt 2 travels around a roll 5 disposed on the outside thereof, thereby forming a calendering zone between the belt 2 and the roll 5. A material web W to be calendered passes through the calendering zone, being thereby subjected or exposed to a pressure impulse and a heat effect as a function of time. FIG. 1 shows in a dash-and-dot line 9 the form of pressure action when on the inside of the calendering belt 2 is mounted a nip roll 4, functioning as a press element and squeezing the belt against the roll 5 to establish a higher pressure within a calendering zone of the nip area. On the other hand, a dash-and-dot line 8 illustrates the form of pressure action when the contact pressure existing in a calendering zone develops only in response to a tension of the belt 2, the nip roll 4 being out of pressing contact with the belt 2 (or when there is actually no nip roll 4 mounted on the inside of the belt 2). The roll 5, like the nip roll 4 as well, may or may not be a deflection-controlled roll and it is selected from the group, including: an elastic surface roll, such as a polymer-covered roll, a rubber-covered roll or an elastomer surface roll, a shoe roll, a thermo roll, a metal roll, a filled roll, and a composite roll. Instead of the roll 4, the press element may comprise some other profitable or fixed-profile press element, which may additionally consist of several members successive in cross machine direction. Also the press element 4, designed in the form of a roll, may consist of several members successive in cross machine direction. The press element 4 may have its surface made continuous or discontinuous. Furthermore, the press element 4 can be made movable or displaceable for changing the processing zone length and/or the belt tension.

In the embodiment of FIG. 1, the nip roll comprises a shoe roll. Reference numeral 6 represents heating elements, such as an induction heater, an infrared radiator, a gas burner, or a capacitive heater. Especially in the case of a metal belt, the inventive solution can be implemented by using elevated temperatures, for example from more than about 100° C. to more than about 200° C., and even up to about 400° C., depending on a particular application. The elevated temperature, together with a long application time and an extensive pressure adjustment capability, provides a good calendering result at both high and low speeds, e.g. at speeds of 100 m/min to 4000 m/min.

FIG. 1*b* shows one variant for the device of FIG. 1, in which an endless belt 2 travels around guiding rollers 3 and press rolls 4. The guiding rolls 3 are made movable for adjusting the belt tension and the press rolls 4 are adapted to move in a direction facing a roll 5, whereby a displacement of the guiding rolls 3 causes the belt 2 to force the press rolls 4 against the roll 5.

FIG. 2 shows an exemplary embodiment, in which the calendering zone is established between two calendering belts 2 and 2*a*, whereby a roll 5*a* present inside the belt 2*a* is optional the same way as the above-mentioned roll 5. Inside the belt 2 may also be mounted a roll or some other press element to form a nip with the roll 5*a*.

Instead of a metal belt described above, the calender belt 2 useful in a belt calender constructed in accordance with the invention may also be e.g. a steel-reinforced rubber belt, a polymer belt, or a covered metal, rubber or polymer belt. The roll 5 may likewise have a hard or soft surface. The belt is preferably made of steel. The belt 2 and/or the roll 5 can be smooth-surfaced or embossed, and the contact area constituted by the belt and/or the roll with a web W to be calendered may travel at a speed other than the web W. The belt coating can be a permanent or movable coating. The coating can be in a granular, liquid, solid form, in the form of elutriated fine fraction, and the coating is capable of a controlled detachment from the belt surface. The belt 2 may have a surface roughness $R_a$ in the order of about 1 μm to about 0.001 μm.

FIGS. 3-7 depict schematically a few optional implementations for a fibrous web processing device, wherein the form or shape of a processing zone is created by using various counter-elements to establish a contact area with a belt, and various press elements for creating a pressure impact in a desired pattern. The counter-elements and press elements may comprise rotating or non-rotating rolls or various support bars. Such elements can also be provided with crowning for controlling a cross-web tension and pressure.

FIG. 3 illustrates a processing zone established by a belt 2 and a roll 5, wherein a pressure impulse is produced by means of the belt tension. FIG. 4 shows, in addition to the belt 2 and the roll 5, a nip roll 4 for applying extra compression force to a presently processed web. FIG. 5 reveals a substantially flat processing zone established between two belts 2 and 2*a*, said solution being optionally provided also with rolls 4 and/or 4*a* placed inside the belt (depicted in dash-and-dot lines in FIG. 5) for supporting the belt 2 or 2*a* within the flat zone. The rolls 4 and 4*a* can form a nip with each other. FIG. 6 shows a solution, in which two belts 2 travel under the guidance of guiding rolls 3 around two bar members 8 and 9 which establish a substantially flat surface. The processing zone develops between the belts 2. The intra-belt element 8 and/or 9 can be biased against the inner surface of a respective belt 2 for creating a desired pressure action in the processing zone. FIG. 7 discloses a solution, in which a belt 2 extends around a dished-surface bar 10 and in which the press element comprises a convex-surface bar 11, around which extends a second belt 2. The processing zone develops between the belts 2.

The inventive processing device is conceivable for use also in the dryer section of a paper/board machine, in which case the belt comprises a metal belt, and the counter-element, establishing a contact area therewith, comprises a drying cylinder.

The inventive processing device enables a supported web passage across a processing zone and allows a controlled fluctuation of the web width within limits defined by the belt width. Web feeding is possible across the full web width and at a high web speed. Web feeding is performed in a conventional fashion, e.g. by means of a cord.

Moisture regulation in a web to be processed can be performed by conventional means, for example by steaming the surface/surfaces of a web prior to passing the web into a processing zone. Moisturization and/or temperature regulation can be used for a desired effect on the cross-web profile and the method enables a wide fluctuation of web moisture.

The intra-web moisture is not able to escape in the processing zone, but remains active in sustaining the web moisture throughout the processing work. On the other hand, traditional multi-nip and soft calenders require several successive nips, the web passages therebetween resulting often in excessive drying of the web.

Various methods of operating a processing device of the invention may also preferably comprise the cooling of a metal belt or a thermo roll to a temperature of about −70° C. to about +50° C., e.g. for condensation. The cooling of a metal belt is feasible, for example, by means of heat transfer to a cooling liquid, an evaporation surface, a cooling cylinder or belt.

For example, the manufacture of glossy printing paper with available technology requires the use of an expensive multi-nip calender. A glossy surface is also obtainable by copying against the surface of a Yankee cylinder at low speeds, as well as by using low pressures and low temperatures. However, the Yankee cylinder has limitations in terms of its speed and width.

In the inventive processing device, implemented as a belt calender, it is possible to employ considerable speeds, and by using also an elevated temperature, e.g. about 250° C., and by taking into account a long dwell time in the processing zone, the resulting glazing effect will be equal to the slower solution obtained by a Yankee cylinder.

Another benefit gained by the inventive solution is a relatively low power demand, since the transmission of energy, heat, and force to a web takes place in a single intensified operation. The heat delivered into a web or a coating layer is not able to escape from the web to ambient air, but remains to participate in increasing the web temperature to facilitate significantly the glazing or polishing of the web surface.

FIG. 8 shows an exemplary embodiment of the present invention, relating to a mechanism for adjusting a compression force caused by a belt tension, in which mechanism the interior of a press belt 2 is provided with two backing belt loops 60, 70, each including a backing belt 62, 72 adapted to extend around guiding elements 63, 73, said backing belts 62, 72 squeezing the press belt 2 in the region of a processing zone against a counter-element, which in the present embodiment comprises a roll 5. Hence, a web W advancing across the processing zone is exposed to a cumulative contact pressure of compression forces resulting from tensions of the backing belts 62, 72. The press belt 2 and the backing belts 62, 72 are individually controlled regarding the tension and running thereof in order to establish a desired contact pressure caused by the belt tensions. The adjustment for tensions of the belts 2, 62, 72 is preferably effected by means of their respective guiding elements 3, 63 and 73, whereof at least one is each time movable in a desired manner for the adjustment of tension applied to the belt (2, 62, 72).

According to FIG. 9, for example, the backing belt 62, 72 can be constituted by adjacent endless cable loops 80, extending around the guiding elements 63, 73 and adjoined for a cable mat, said cable mat being preferably covered with rubber at least on one side. The backing belt can also be designed e.g. as a track-like belt. The use of flexible backing belts 62, 72 eliminates the need of increasing the thickness of the belt 2 in view of improving the belt strength to enable the use of increased tensions. Such increase in thickness would cause problems in terms of bending strength, the result being a belt fatigue unless the roll diameters were increased respectively. As far as bending strength is concerned, it is a generally accepted rule of thumb that the smallest roll diameter included in a belt loop should be about a 1000 times the belt thickness.

In reference to FIG. 10, there is shown a device of the invention, implemented as a belt calender 1, comprising a metal-constructed calendering belt 2 extending around guiding rolls 3, at least some of said guiding rolls being displaceable for adjusting the belt 2 to a desired tension (force F1), as well as for possibly adjusting the length of a contact area or processing zone between the belt 2 and a counter-element 5, for example by changing an overlap angle between the roll 5 and the belt 2. The calendering belt 2 runs around the roll 5 disposed on the outside thereof, a calendering zone developing between the belt 2 and the roll 5. A material web W to be calendered proceeds through the calendering zone, being thus subjected to a pressure impulse and a heat effect as a function of time. FIG. 10 has a dash-and-dot line 9 representing the pattern of pressure impact when the calendering belt 2 is provided on the inside thereof with a nip roll 4, functioning as a press element and squeezing the belt against the roll 5 (force F2), thus establishing a higher pressure within a calendering zone of the nip area. On the other hand, a dash-and-dot line 8 represents the pattern of pressure impact when the contact pressure existing in the calendering zone is established only by means of a tension of the belt 2 (force F1), the nip roll 4 being out of the compression contact with the belt 2 (or with no nip roll 4 fitted inside the belt 2).

The roll 5, like the nip roll 4 as well, may or may not be a deflection-compensated roll and selected from a group, comprising: an elastic surface roll, such as a polymer-covered roll, a rubber-covered roll or an elastomer surface roll, a shoe roll, a thermo roll, a filled roll and a composite roll. In the embodiment shown in FIG. 10, the nip roll comprises a shoe roll.

FIG. 11 depicts another variant for a device of the invention, which employs two belt loops, belts 2 and 5*b*. In the embodiment shown in FIG. 11, as well as in FIG. 12, the belt 5*b* thus constitutes a counter-element together with a press roll 5*a*.

In the embodiment of FIG. 12, the number of nip rolls 4 is two, and in the embodiment of FIG. 13, the number is three. In the embodiment of FIG. 12, it is further possible to also shift and load the nip rolls 4 as indicated in the figure. This enables adjusting both the length and pressure of a processing zone.

According to the invention, the temperature adjustment of a web W is essentially effected by adjusting temperature of the belt 2 (FIGS. 10, 14-16). Reference numeral 6*a* represents heating elements with a direct effect on the belt 2, such as, for example, an induction heater, an infrared radiator, a gas burner or a capacitive heater. Heating elements 6*a*, 6*b* can also be arranged on both sides of the web W. Having a direct effect on the belt 2 results in a temperature adjustment as quick as possible, thus facilitating also a quick change-over from one paper grade to another. In addition, the heating elements 6*a*, 6*b* are preferably positioned immediately upstream of the point at which the web W is introduced onto the belt 2 by means of a belt guiding element 3.

In one preferred embodiment of the invention, the heating element 6*b* can also be provided with cooling for speeding up temperature adjustment. The belt 2 can have its cooling performed, for example, by means of water jets, and even in such a way that the only surface of the belt 2 exposed to water will be the one opposite to the surface forced into contact with the web W.

In one solution of the invention, the belt 2 has its heating effected conductively as shown in FIG. 14, the belt 2 being supplied, for example by means of conductors 51, 52 through guiding elements 3, with a high electric current which converts into heat as a result of the internal resistance of the belt 2.

According to the invention, the belt 2 can also have its heating effected indirectly, through at least one roll 3*a* (FIG. 10). The roll 3*a* can be heated by any conventional heating method, preferably from inside, with water, steam, oil, or internal combustion. With respect to the web W, the roll 3*a* is arranged to enable bringing it into contact with the web by moving the roll 3*a* in the direction indicated by an arrow relative to the web, and by using auxiliary rolls 50 for guiding the same to travel around the roll 3*a* in contact therewith.

The belt 2 can also have its heating effected by using simultaneously one or more of the above-mentioned methods.

According to the invention, it is also possible to provide the belt 2 with an increased tension within the confines of a processing zone. This is done by arranging, for example, drawing and/or braking elements, such as tension and/or drag rolls, on either side of a roll 5, such that the roll 5 is exposed to an extra tensile force, directed upwards in the figure, the belt 2 having its maximum tension between the guiding elements 3 located upstream and downstream of the processing zone. The belt 2 has a respectively lesser tension in other sections of the belt loop. This facilitates, for example, the setting of said roll 3*a* in contact with the web W. Another benefit is that the belt loop tension can be lowered outside the processing zone to such an extent that the belt loading is not within a fatigue range. The service life of a belt designed for fatigue loading will be multiplied, if the belt is within a fatigue load range at a single roll only. Such a local adjustment of tension can be further used for setting the vibrational mode of a belt within a desired range, and for contributing to the distribution of a nip force.

Generally speaking, the belt tension in various belt loops of a paper/board machine or a finishing machine, especially in the belt loop of a metal belt calender, can be adjusted locally, according to the present invention, by adjusting the moment of rolls presently in contact with the belt so as to achieve a desired local tension. The moment of rolls in contact with a belt can be adjusted by means of drives, brakes acting on the rolls or eddy currents creating a moment for the roll and/or the belt.

FIG. 15 shows one device of the invention, implemented as a belt calender, comprising a metal-constructed calendering belt 2 extending around guiding rolls 3, at least some of said guiding rolls being displaceable for adjusting the belt 2 to a desired tension. This device of FIG. 15 is substantially consistent with that of FIG. 1, having just reference numeral 6 to indicate a plurality of heating and/or cooling elements. The heating element comprises, for example, an induction heater, an infrared radiator, a gas burner, a hot-air blower or a capacitive heater. The cooling elements comprise, for example, a cooling air blower or a liquid cooling plant. In the solution shown in FIG. 15, the heating and/or cooling elements 6 are preferably profiling, whereby the temperature profiling of a belt can also be used to influence a lateral distribution of the machine directed tension of the belt. The lateral profiling of a belt temperature and/or tension has an effect on the profiling of the properties of a presently processed web and, furthermore, the profiling of temperature and/or tension can be used for guiding and/or controlling the belt.

Figure 1:
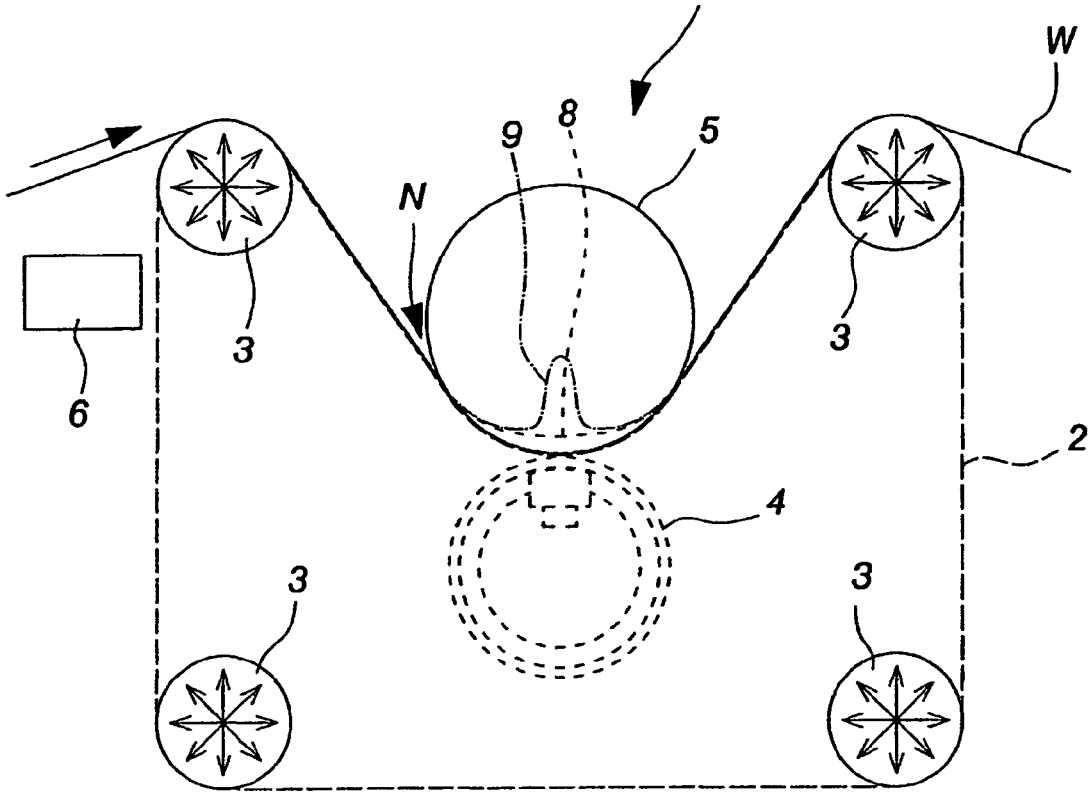
Figure 1B:
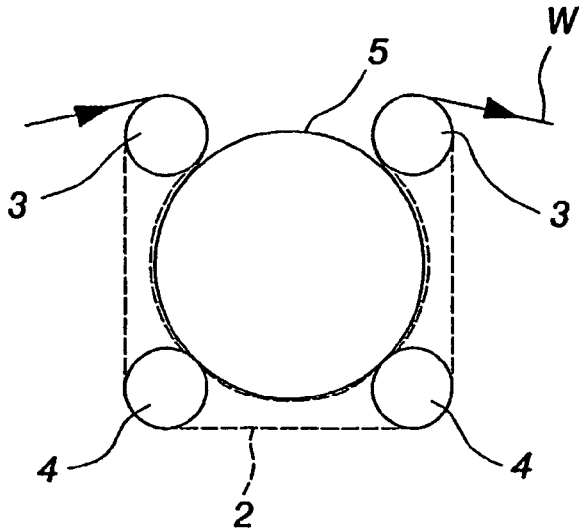
Figure 2:
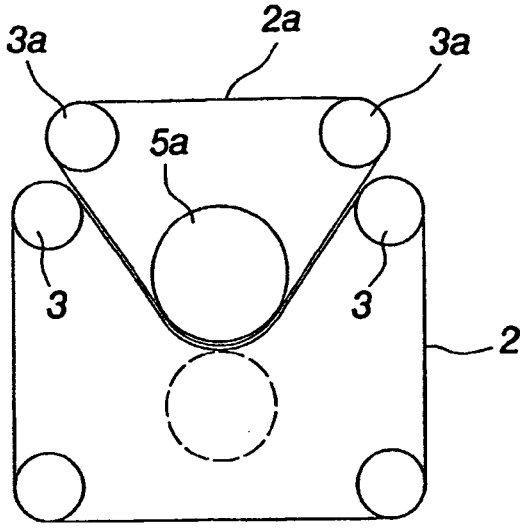
Figure 3:
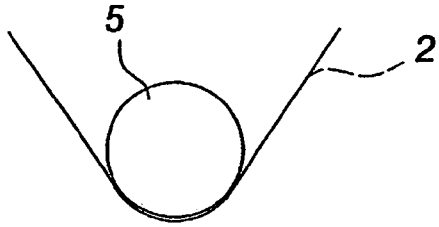
Figure 4:
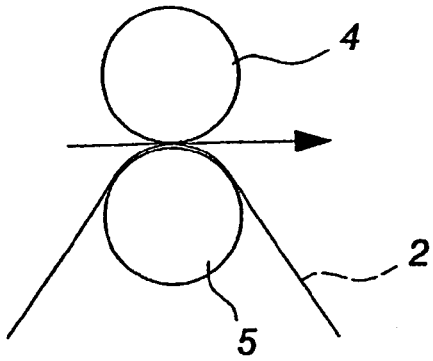
Figure 5:
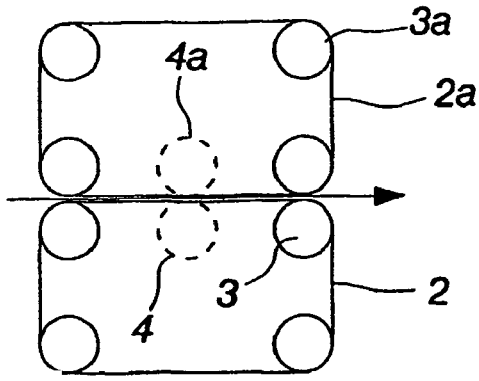
Figure 6:
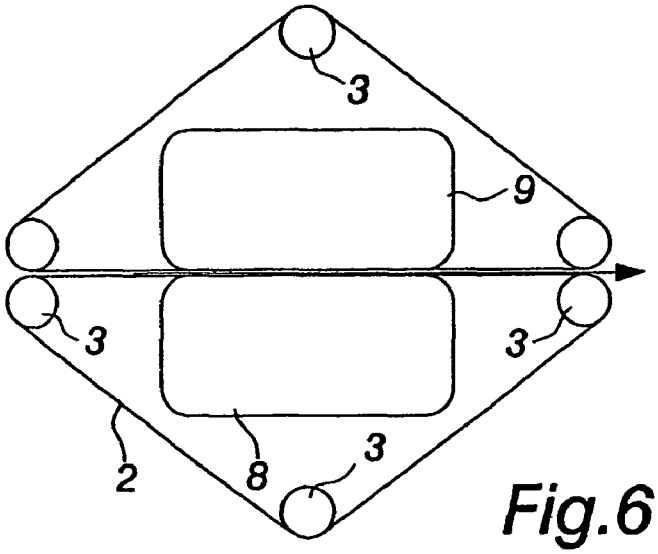
Figure 7:
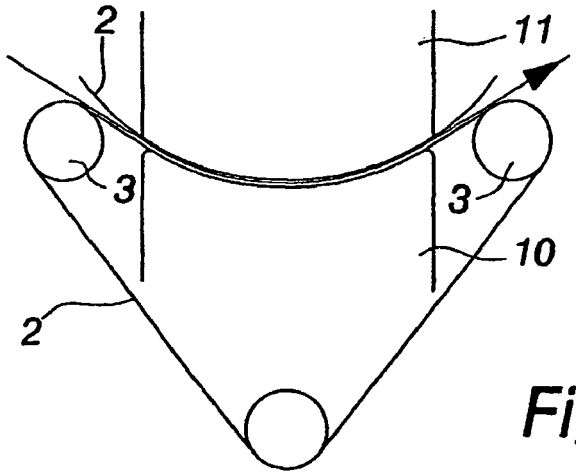
Figure 8:
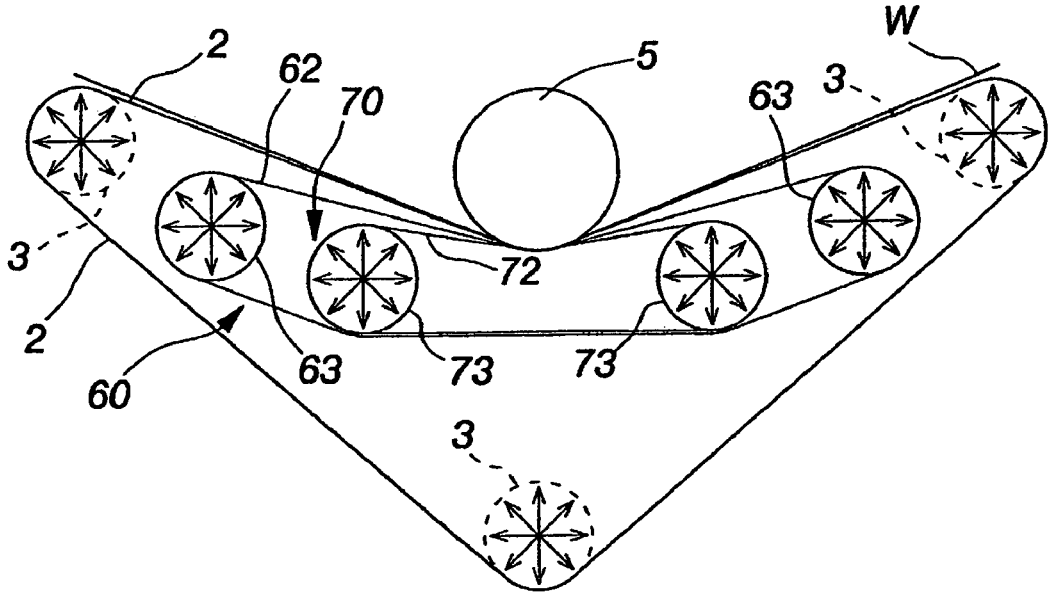
Figure 9:
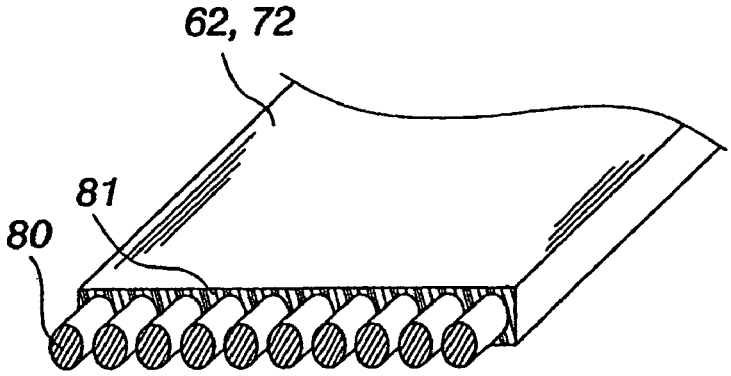
Figure 10:
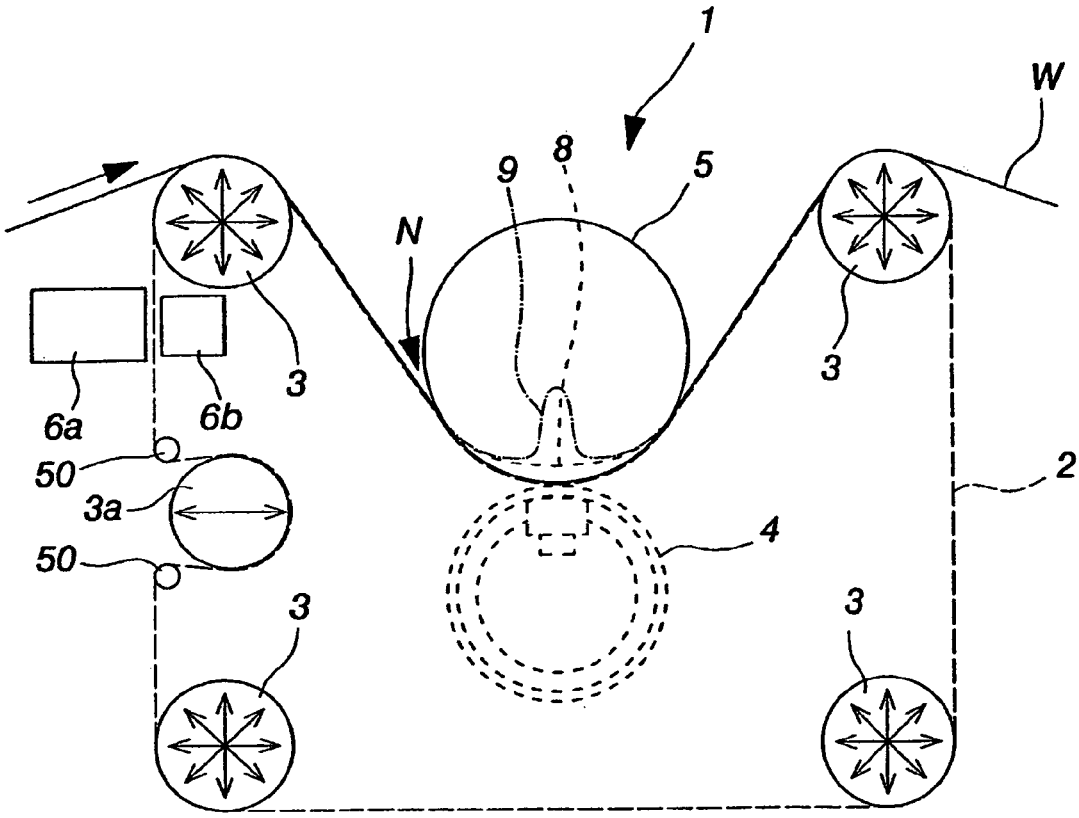
Figure 11:
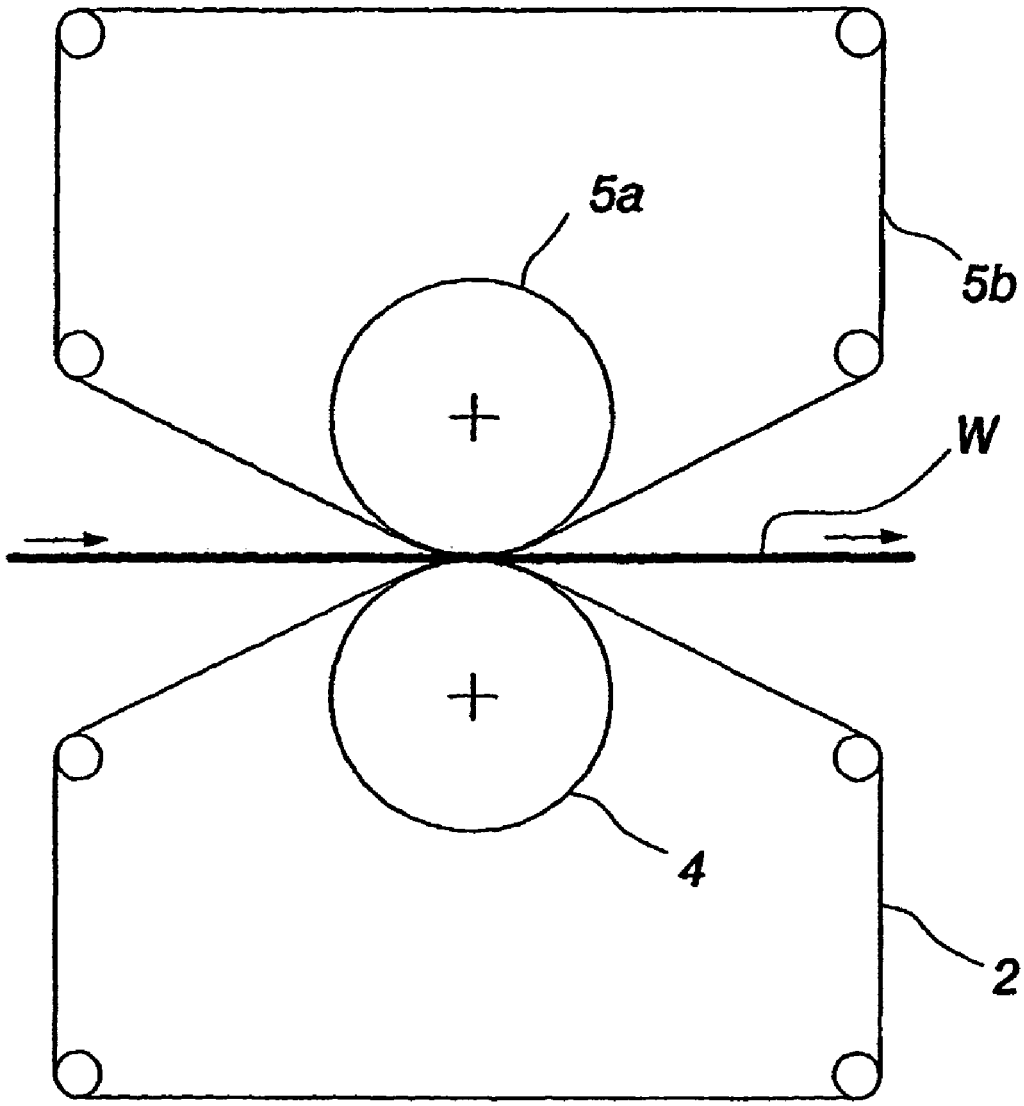
Figure 12:
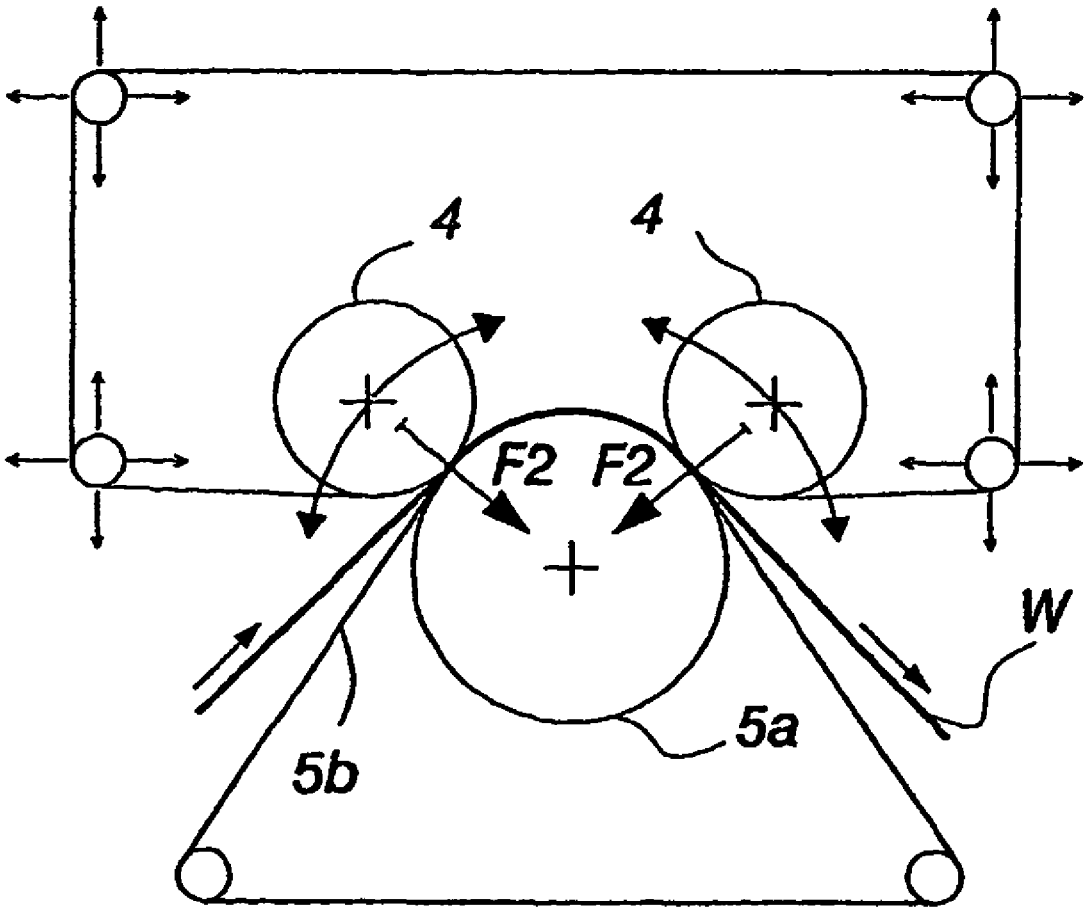
Figure 13:
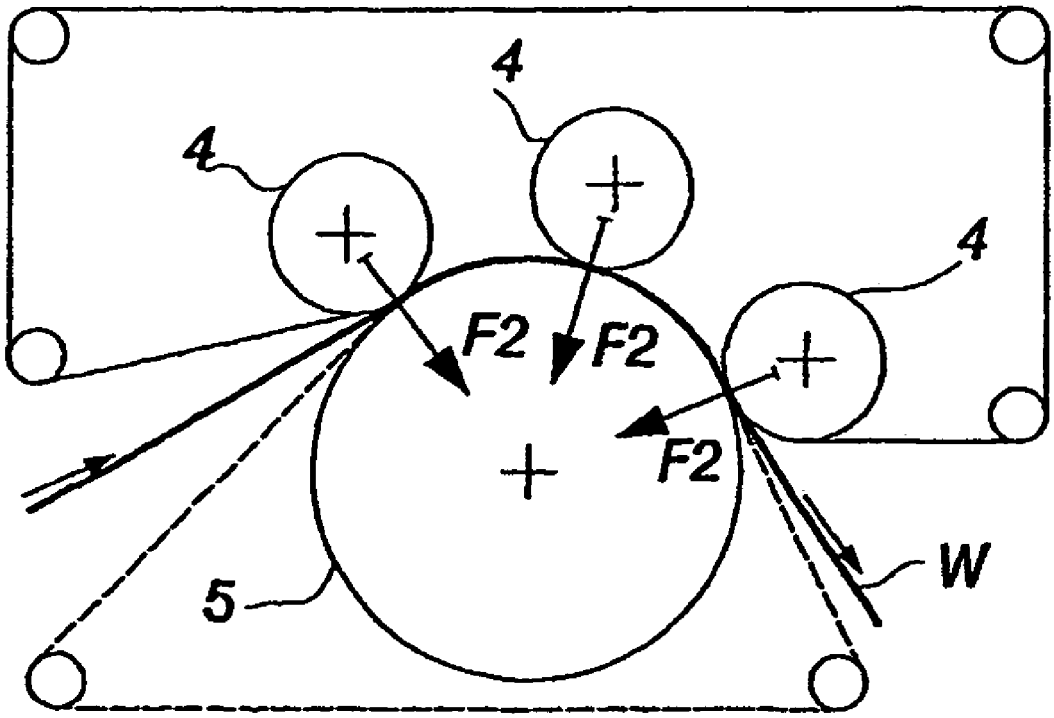
Figure 14:
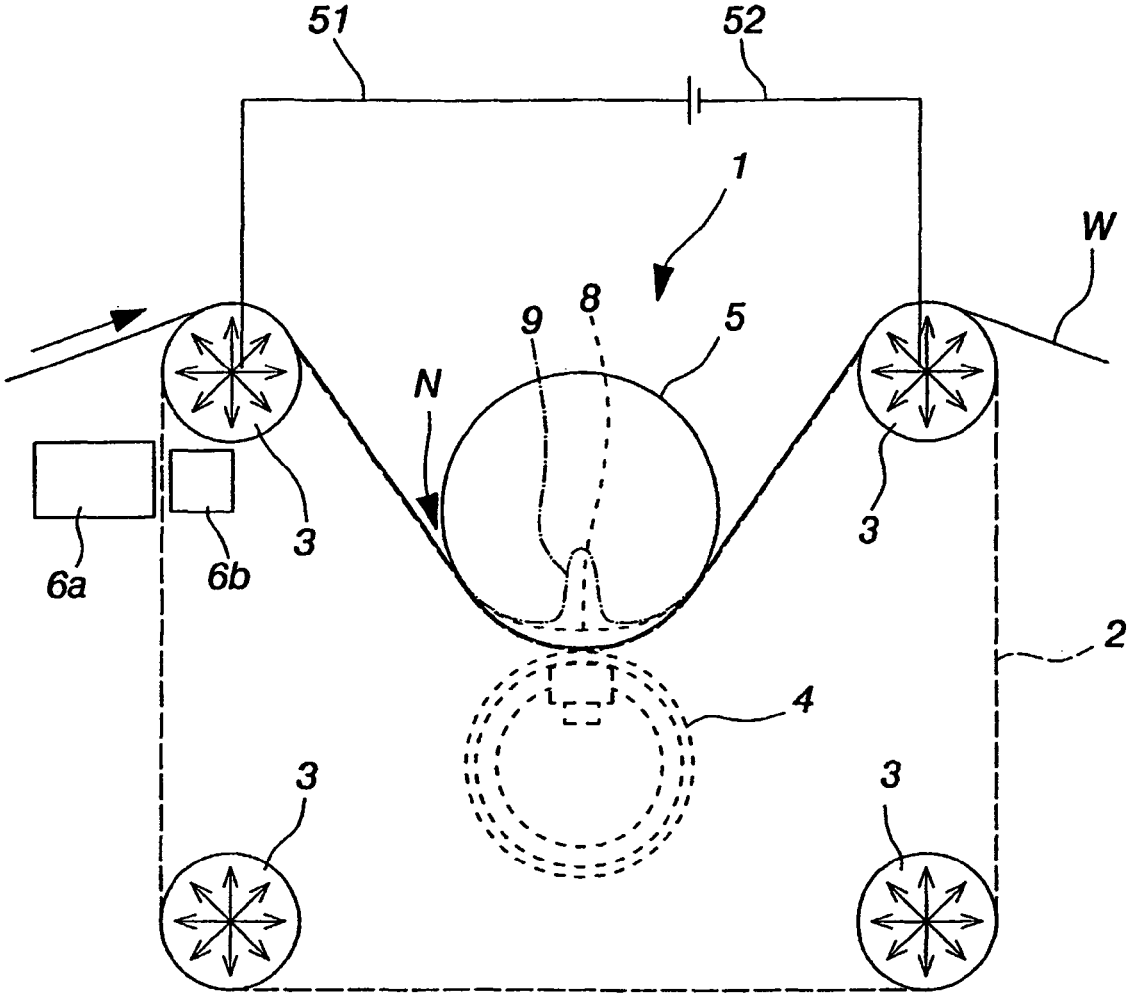
Figure 15:
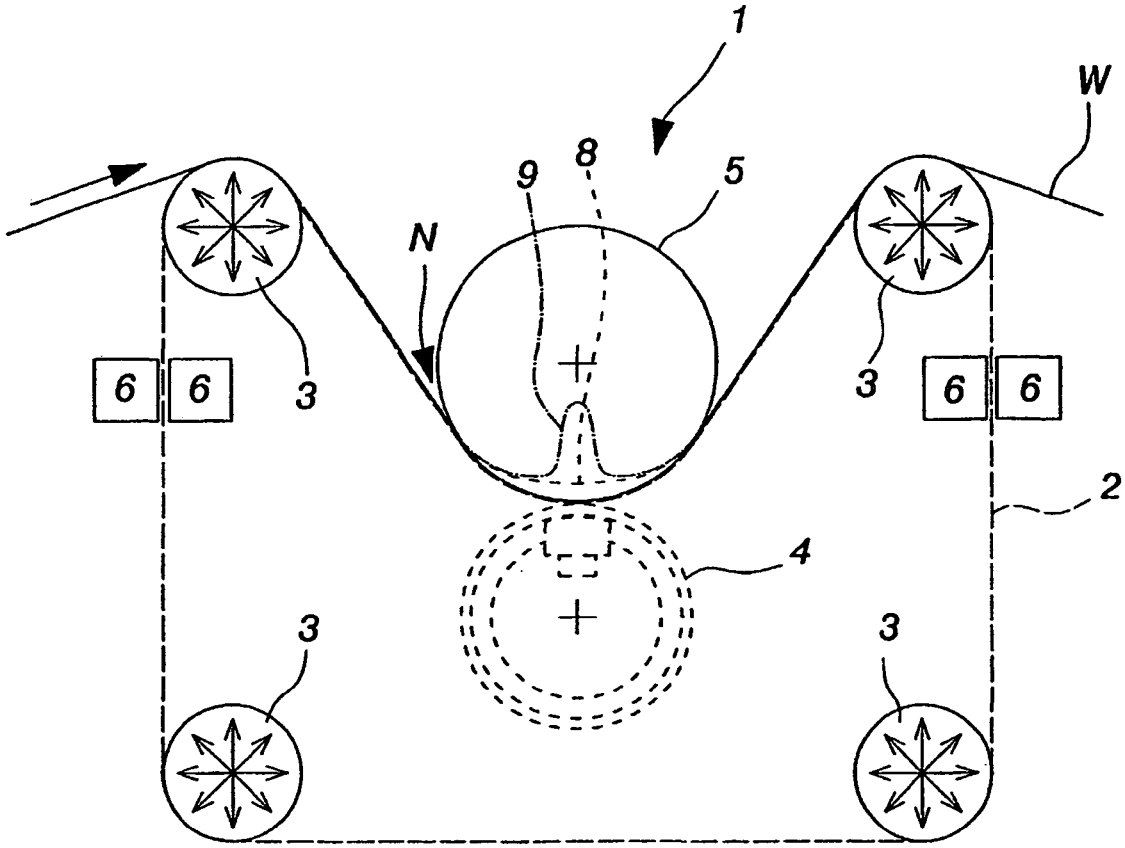
Figure 16:
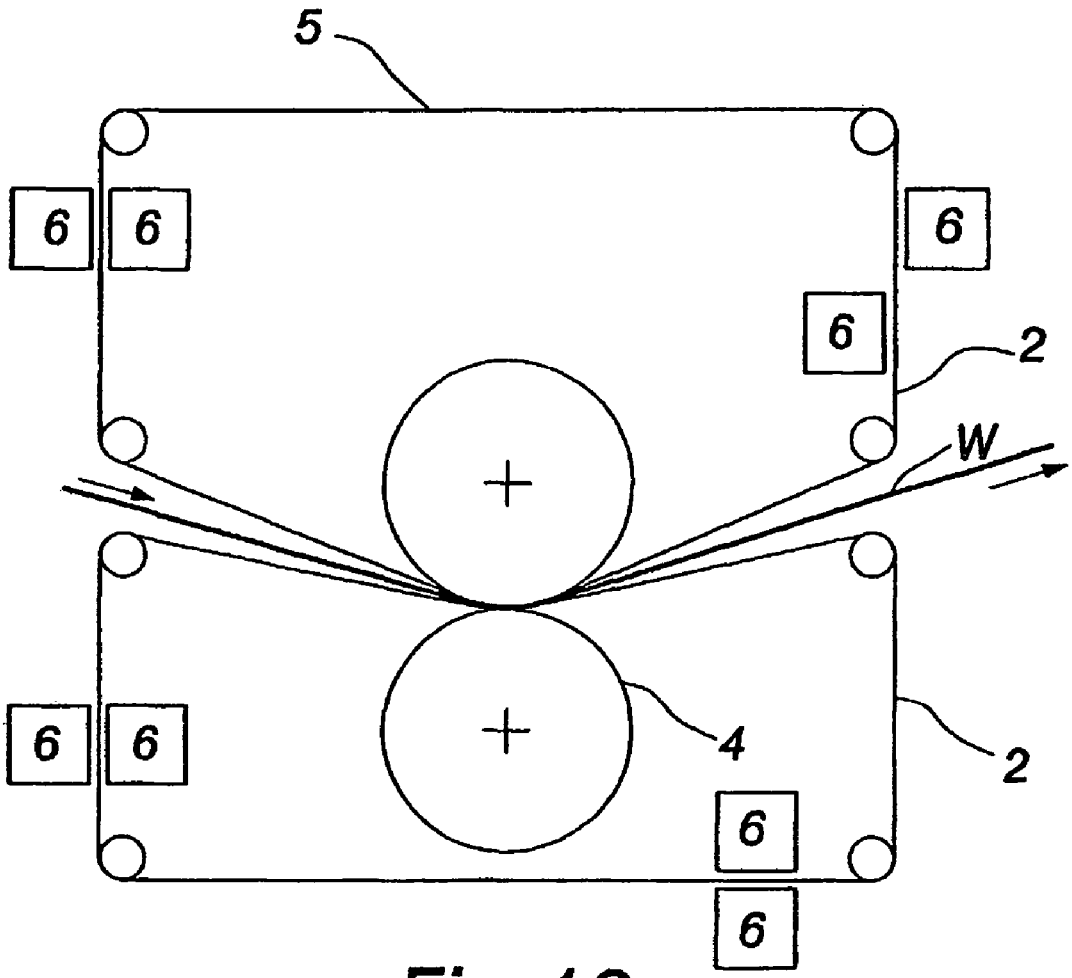
FIG. 16 illustrates an exemplary embodiment, wherein the roll is replaced by a second calendering belt as a counter-element 5, a calendering zone developing between two calendering belts 2.
Figure 17:
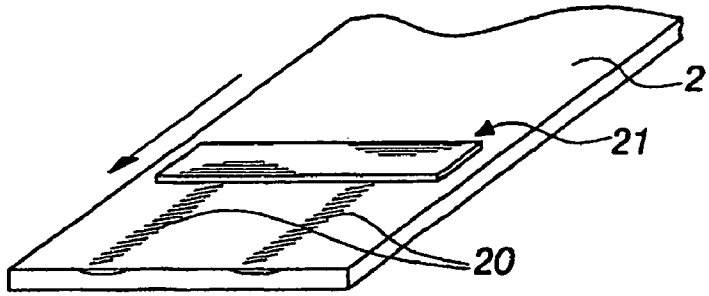
FIGS. 17-21 depict the actions of lateral temperature profiling on a belt in an example, in which the belt heating is effected by means of a profiling induction heating unit.
Figure 18:
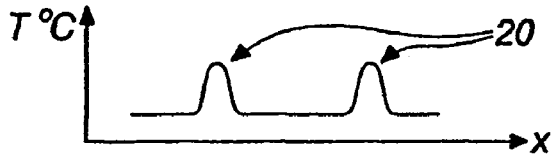

The heating effect of a high-frequency (20 kHz) induction has an estimated penetration into an iron or steel material in the order of 0.05 mm. This is but a fraction of the metal belt thickness as the latter is in the order of 0.5-1 mm. This means that the heating effect is applied to the surface of a belt locally (FIGS. 17 and 18). One-sided heating builds up a belt deflecting moment as the heated surface strives to expand locally. On the other hand, the temperature of a thin belt equalizes at the heated spot quite rapidly in perpendicular direction and the heated spot strives to expand more vigorously than the rest of the area also in longitudinal and lateral directions.

Figure 19:
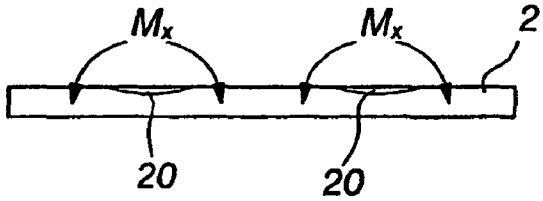
Figure 20:
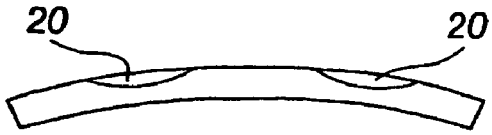
Figure 21:
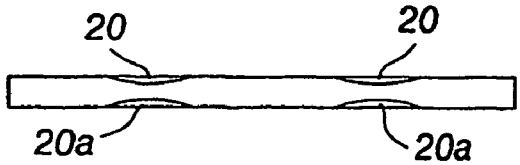

The one-sided temperature distribution of a belt develops a bending moment, as a result of which the belt tends to form "bulges" (FIGS. 19 and 20). This can be eliminated by the application of heating symmetrically on both surfaces of the belt (FIG. 21).

Supposing that the steel belt has a modulus of elasticity of E=200,000 MPa and a thermal expansion coefficient of $1\cdot10^{-5}$, at the tensile stress of 100 MPa (a typical value) the resulting belt elongation will be $5\cdot10^{-4}$, which on the other hand is consistent with an elongation caused by a temperature change of 50° C. If temperature profiling falls short of this, the hottest spots shall also remain within the domain of tensile stress. This is meaningful in the sense that it makes the belt less prone to buckling (collapsing). If the average tensile tightness of a belt is even higher, the temperature profiling will also have more leeway.

Ideally, the belt is manufactured in a material with almost no thermal expansion (e.g. invar). This would offer more possibilities for temperature profiling.

In the case of other heating methods, such as, for example, profiling hot-air injectors and profiling cooling devices, the belt need not consist of a metal alloy suitable for induction, as it can be made, for example, in a composite material.

Instead of direct profiling heating applied to a belt, the profiling heating can also be effected in such a way that the belt loop includes at least one roll, having a lateral temperature profile which is adjustable. Heating of the roll can take place internally, e.g. by the application of induction heating, an infrared radiator, a gas burner, a hot-air fan, capacitive heating, or heating based on the circulation of a hot liquid, e.g. water or oil.

In addition to or instead of tension adjustment based on profiling temperature regulation, the adjustment of a tension profile in a belt can also be effected by other means. Such means include e.g. elements for deviating at least one guiding roll present in a belt loop in the radial direction of the roll and/or in its axial direction (change of alignment). Instead of a roll, the guiding element may also comprise a non-rotating bar-shaped guide element. The tension profile adjustment elements may also include a roll present in a belt loop, whose crowning or curvature is variable. The adjustment elements may also include a deflection-compensated roll present in a belt loop, which is profitable zonewise by means of intra-roll forces.

Figure 22:
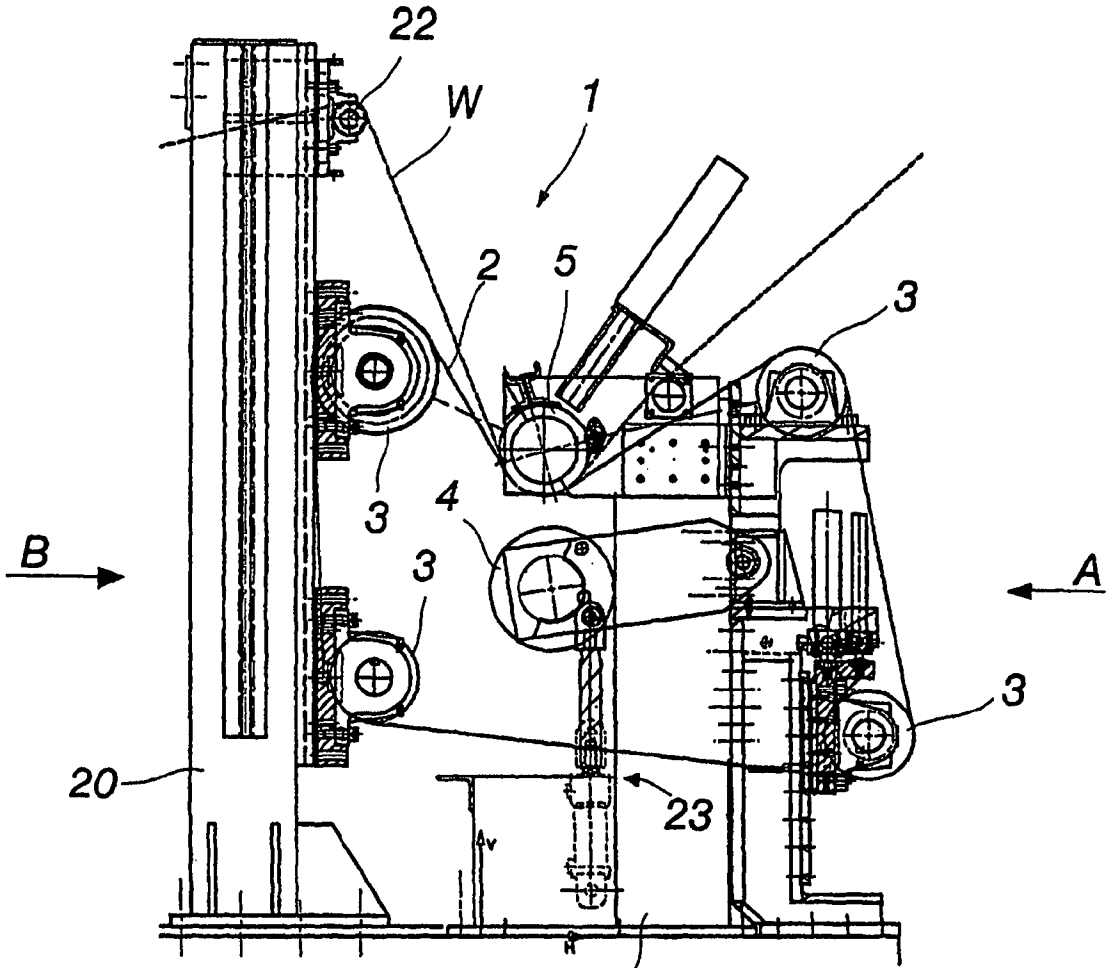
Figure 23:
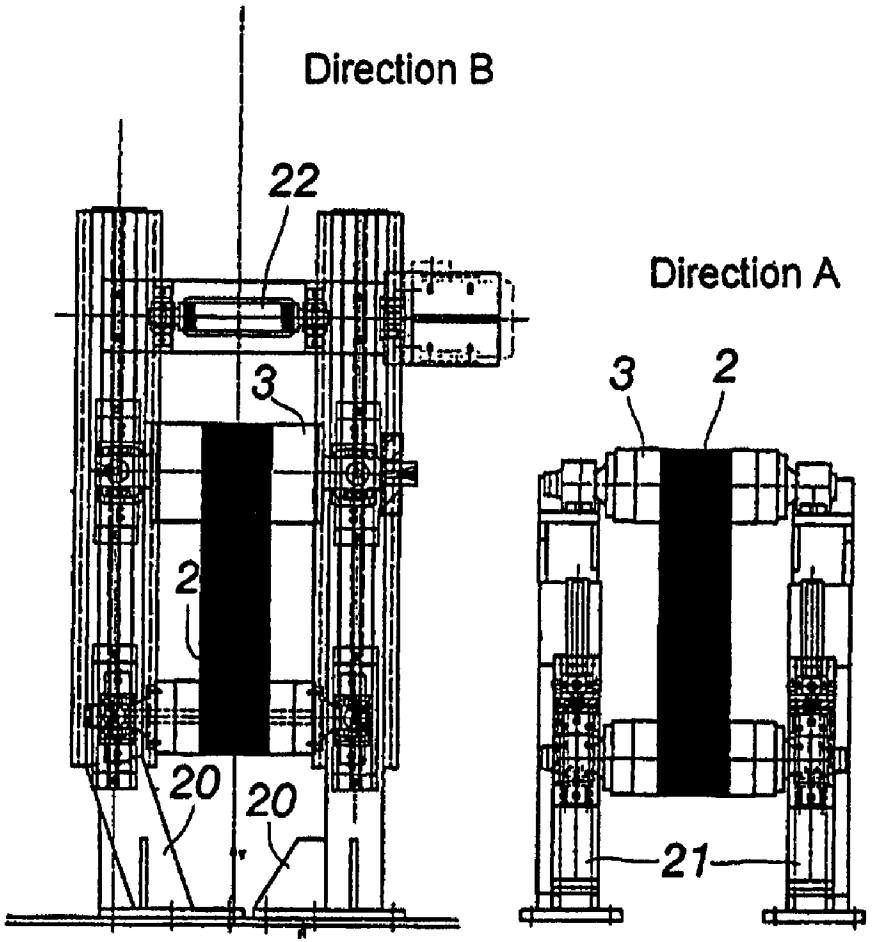

FIGS. 22 and 23 depict schematically portions of a pilot machine constructed in accordance with the invention in diagrammatic side and end views, the corresponding components being indicated by reference numerals consistent with those of the preceding figures. Reference numeral 20 represents a first upright frame for the pilot machine, on which are mounted first guiding or guide rolls 3 for a belt 2 by means of per se known bearing assemblies. The upright frame 20 is further fitted, by means of per se known bearing assemblies, with a guiding roll 22 for a web W. Reference numeral 21 represents a second upright frame for the pilot machine 1, on which are mounted second guiding or guide rolls 3 for the belt 2, as well as a counter roll 5 and a press roll 4. A processing zone develops between the belt 2 and the counter roll 5, the web W being carried through said processing zone. The press roll 4 is confined inside the belt loop 2 and can be brought by loading elements 23 into contact with the inner surface of the belt 2 for establishing, together with the counter roll 5, a higher pressure nip area within the processing zone.

Figure 24:
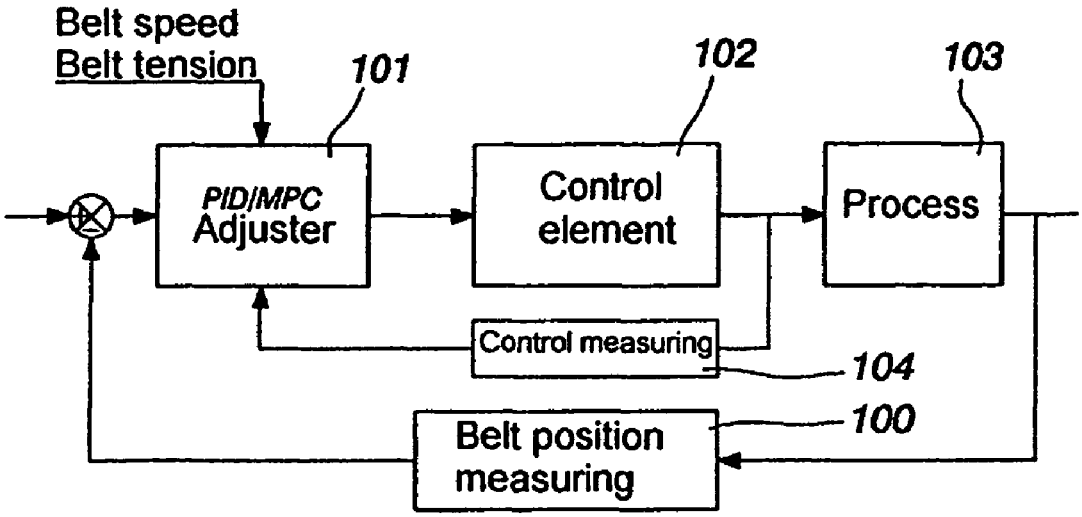

FIG. 24 is a diagrammatic representation relating to the adjustment of a belt in a belt calender. A particular challenge regarding the adjustment of a belt is the variation of control engineering features in the system: the behaviour of a belt varies according to the cross machine (CD) and machine (MD) directed belt tension and the belt speed, which variables must be regarded as dynamic variables in terms of adjustment. In the process of designing the adjuster or controller, it is further necessary to consider static system parameters, such as belt width, belt thickness, disposition and surface contour of guiding rolls, distances between guiding element and measuring element.

Reference numeral 100 in FIG. 24 indicates a belt position measurement, which can take place before and/or after a guiding element. Measuring principle may be an optical or inductive or capacitive identification of the position of a belt edge. reference numeral 101 represents an adjuster, which is based on a conventional PID controller, having the values of its parameters adapted to match the current belt speed and tension values. In the most demanding applications, the controller can be model-based (e.g. MPC=Multi Predictive Control), which takes dynamic process variations into account. Reference numeral 102 designates a guiding element, having an angle of incidence which is variable relative to the belt travel direction. A change in the incidence angle of the guiding element is achieved by means of a separate deviation means connected to the guiding roll, which can be hydraulic, pneumatic or electric. Reference numeral 104 relates to a deflection measurement and reference numeral 103 to an actual process, such as e.g. calendering. The belt position can be adjusted in a cross direction to progress in accordance with a desired fixed or tempolabile positional set value.

Figure 25:
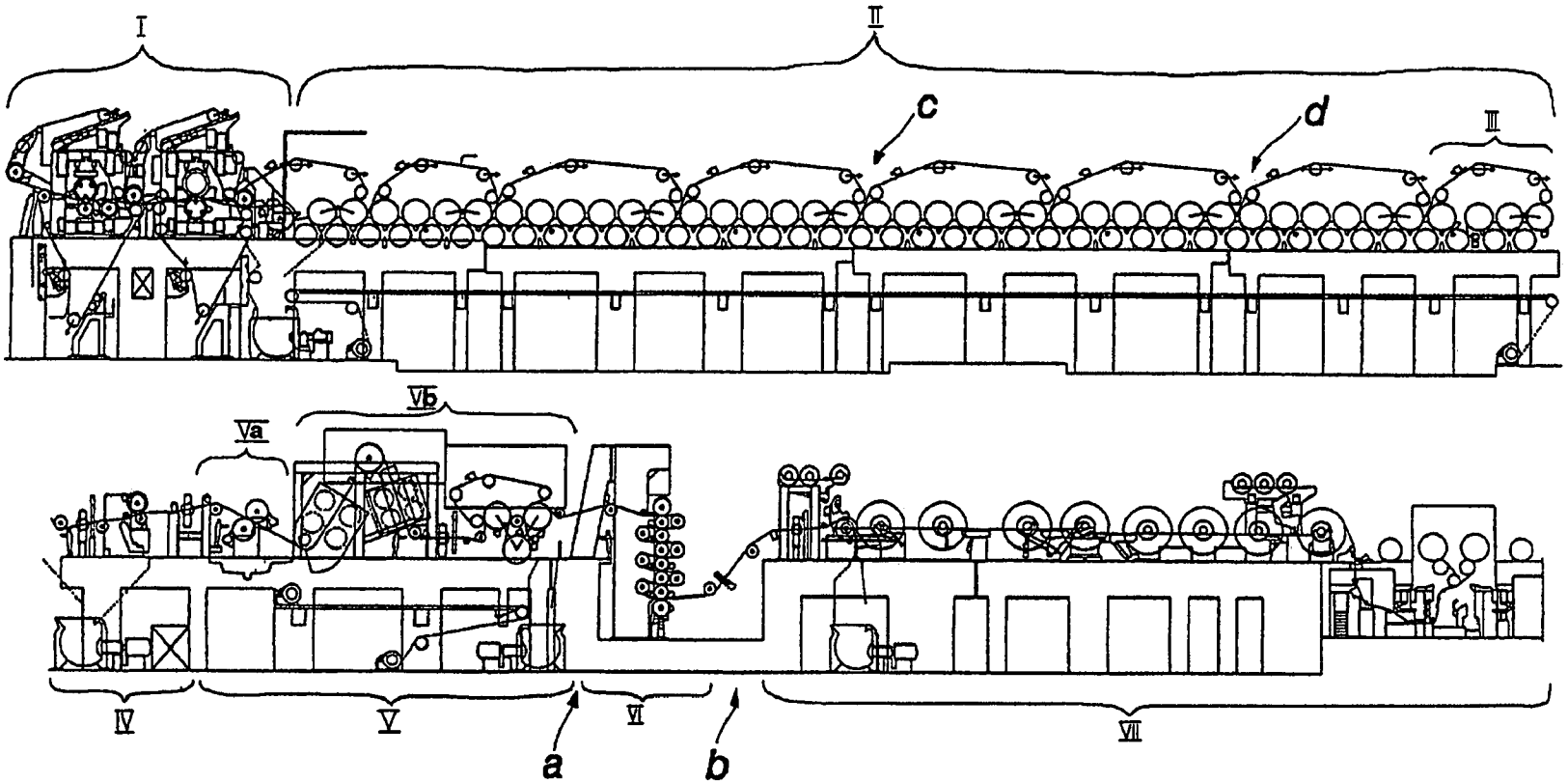

FIG. 25 illustrates one embodiment for an LWC paper production line, depicting various sections of the line from a press section I onwards. The press section is followed by a dryer section II, having its tail section indicated by reference symbol III. The dryer section is followed by a pre-calendering section IV, and then by a coating process V which is divided for a coating station Va and a drying section Vb. The coating station is followed by a final calendering process VI, and ultimately by finishing processes VII, including e.g. slitting-winding operations. Conceivable positions for a processing device of the invention are e.g. those indicated by reference symbols a, b, c and/or d in an on-line LWC paper production line. In addition to or instead of these positions, it is conceivable that a processing device of the invention be used to replace, for example, the dryer section's tail portion III and/or the pre-calender IV and/or the final calender VI.

Generally, it can be said that a processing device of the invention provides a very high efficiency for calendering and/or other work in a single operation. This can also be exploited in such a way that a processing device of the invention is combined with another calender for increased calendering capacity. Such other calender may comprise e.g. a supercalender or a multi-roll calender, e.g. a multi-roll calender manufactured under the name OptiLoad, or e.g. a soft calender or a long-nip calender. The production of e.g. SC and LWC paper involves typically the use of 10-12-roll super- or multi-roll calenders. Modern paper machine, with an operating speed of 1800-2000 m/min, require up to 4 supercalenders or multi-roll calenders per paper machine. Typically 2 or 3 off-line calenders can handle the production of one paper machine. Calendering speed vary within the range of 500-700 m/min. Nip pressures are typically 300-400 kN/m and the thermo roll surface temperature is within the range of 80-120° C. The two-sidedness of paper can be controlled by reversed positioning of the top and bottom nips of a calender, by different temperatures or steaming levels. SC-C and SC-B grades, which lie between newsprint and smooth SC papers, can be produced also by means of two-nip soft calenders. Surface temperature in running is 160-200° C. and nip pressures are up to 350 kN/m. Steaming is also an essential part of calendering these grades.

When a metal belt calender of the invention is combined e.g. with an OptiLoad calender, the metal belt calender is positioned preferably immediately upstream of the first nip or downstream of the last nip of the OptiLoad calender. It is also conceivable that the metal belt calender be positioned between the stacks of a two-stack calender. The metal belt calender can also be positioned upstream or downstream of a single- or double-nip soft calender for raising the performance of said soft calender. Metal belt calendering is intended for compacting and heating a presently processed fibrous web upstream of a multi-roll calender or a soft calender or downstream thereof, or possibly also in an intermediate stage (e.g. between the stacks of a two-stack calender). The enhanced calendering process is a way of attaining faster running speed than those available at present.

The inventive device allows for very extensive pressure, temperature, and dwell time windows, offering a variety of combinations depending on a particular application. For example, the pressure window can be within the range of about 0.01 MPa to about 70 MPa, or even as high as about 200 MPa, temperature can be within the range of about −70° C. to about +400° C., and the dwell or residence time in a processing zone can be e.g. within the range of about 0.01 ms to about 2 s, or even in the order of 10 s. In addition, various machine speeds can be used for manufacturing various grades. The inventive device can be an on-line or off-line device.

Figure 26:
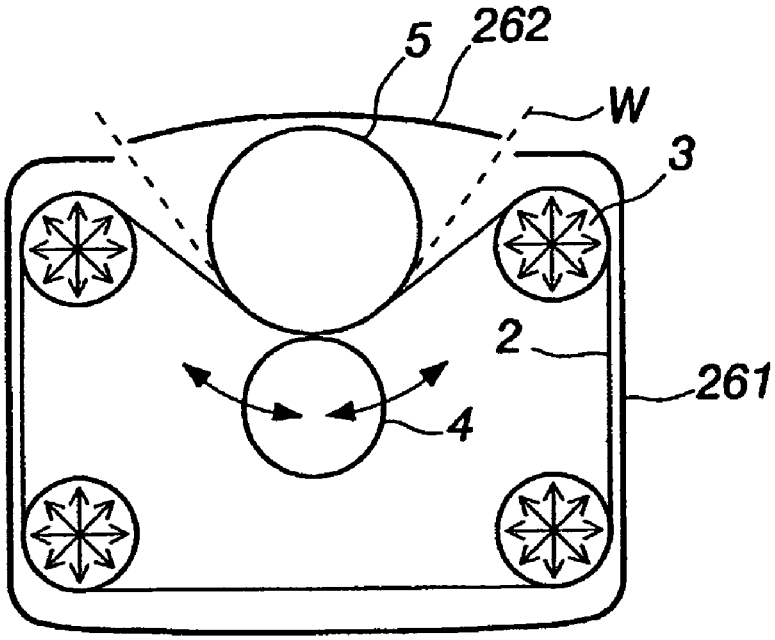
Figure 27:
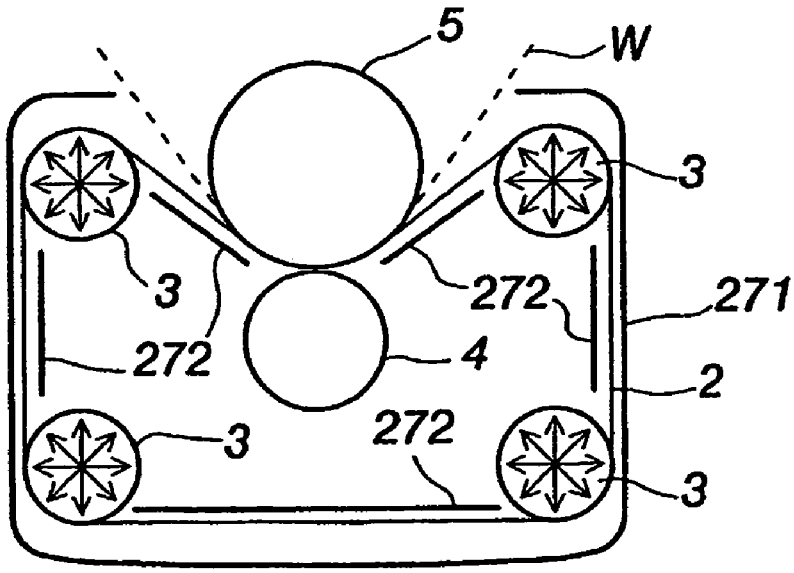
Figure 28:
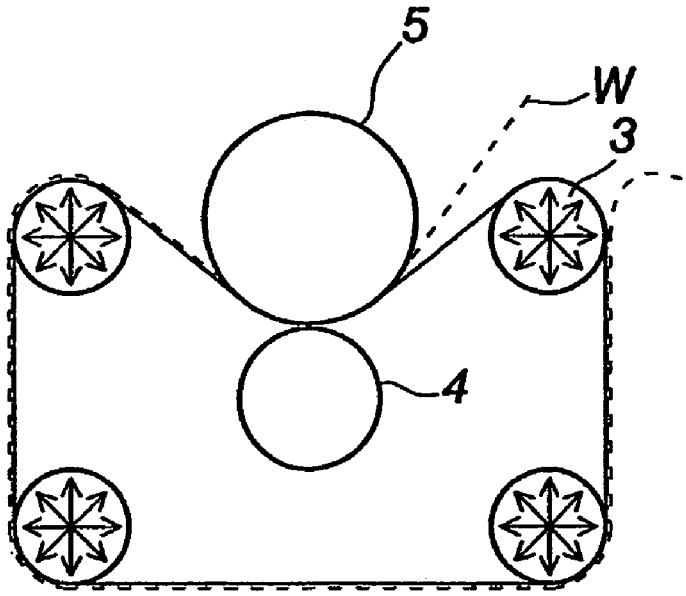

FIGS. 26-28 illustrate various optional embodiments for minimizing heat losses from a heated metal belt in a processing device.

FIG. 26 depicts a solution, wherein the belt loop 2 is encircled by "a hood" 261, inside which the air temperature can be higher than elsewhere in the ambience (e.g. 50-150° C.). The hood divides internal and external spaces, primarily by preventing mixing of air masses therebetween.

FIG. 27 depicts a solution, wherein the belt 2 is shielded from outside with a hood 271 and additionally from inside with thermal radiation blocking panels 272.

FIG. 28 depicts a solution, wherein a web W builds "a hood" outside the belt 2. In this solution, the web W is adapted to make contact over a substantial part of the external surface of the belt loop 2. The contact promotes transfer of heat from belt to web, but this time it is recovered in the process instead of going to waste. Preferably, the paper web has a contact as long as possible before the actual processing zone between the belt 2 and the counter roll 5.

Figure 29:
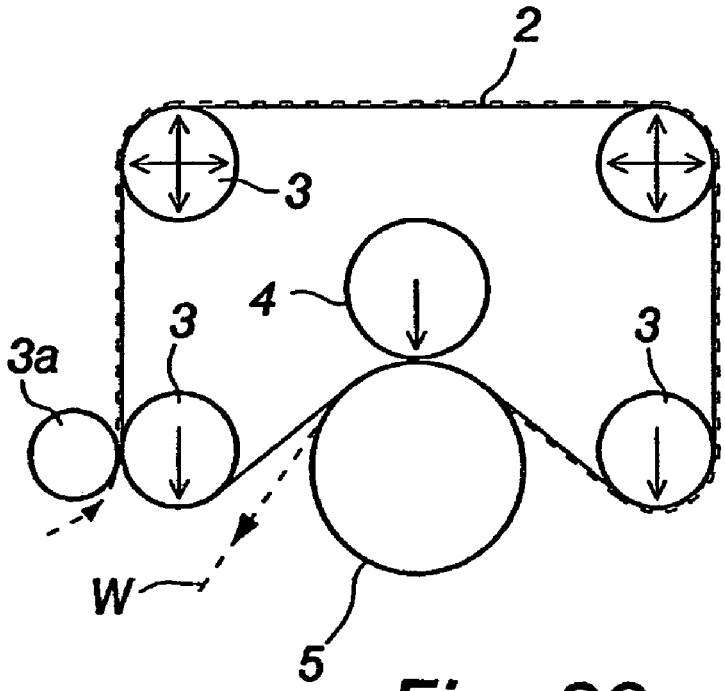

FIG. 29 depicts a solution consistent with FIG. 28, wherein the relative positions of a belt loop 2 and a counter roll 5 are reversed. At least some of the rolls can be secured in position under their own weight.

It is also conceivable to provide a solution, wherein only the air volume inside a belt loop is sealed.

That which is claimed:

1. A processing device for processing at least one of a coated fibrous web and an uncoated fibrous web, consisting of a belt configured to extend around at least one guiding element, the belt being at least one of a metal belt and a metal-based belt having a thickness of between about 0.1 mm and about 3 mm and a tensile strength within the range of between about 10 MPa and about 500 MPa, at least one counter-element comprising a deflection-compensated roll and being disposed outside said belt to provide a contact area with the belt, such that the belt and the at least one counter-element establish therebetween a web processing zone for passing the web to be processed therethrough, wherein a length of the processing zone in a machine direction is defined by at least one of the disposition of the guiding element and the configuration of the at least one counter-element, and wherein a contact pressure applied to the web in the processing zone is within the range of between about 0.01 MPa and about 200 MPa.

2. A device as set forth in claim 1, wherein the belt comprises at least one of a steel belt, a steel-reinforced rubber belt, and a covered belt.

3. A processing device for processing at least one of a coated fibrous web and an uncoated fibrous web, said device consisting of a belt configured to extend around at least one guiding element, the belt being at least one of a metal belt and a metal-based belt having a thickness of between about 0.1 mm and about 3 mm and a tensile strength within the range of between about 10 MPa and about 500 MPa, at least one counter-element comprising a deflection-compensated roll and being disposed outside said belt to provide a contact area with the belt, such that the belt and the at least one counter-element establish therebetween a web processing zone for passing the web to be processed therethrough, wherein a length of the processing zone in a machine direction is defined by at least one of the disposition of the guiding element and the configuration of the at least one counter-element, wherein a contact pressure applied to the web within the processing zone is within the range of between about 0.01 MPa and about 200 MPa, and wherein the processing device is provided with heating elements for controlling an operating temperature of the belt within the range of between about 50° C. and about 400° C.

4. A device as set forth in claim 1 or 3, wherein the processing device comprises at least one of a calender, a coater, a sizer, a printer, a dryer, and a press.

5. A device as set forth in claim 1 or 3, wherein the belt thickness is within the range of between about 0.3 mm and about 1.5 mm.

6. A device as set forth in claim 1 or 3, wherein the at least one counter-element comprises a second belt loop.

7. A device as set forth in claim 1 or 3, wherein the belt has an embossed surface for producing a desired embossment on the web.

8. A device as set forth in claim 3, wherein the belt is heated by at least one of a liquid-gas operated infrared radiator, a natural-gas operated infrared radiator, an electrically operated infrared radiator, and an induction heating device.

9. A device as set forth in claim 3, wherein the belt is heated by providing said at least one heatable roll for heating the belt through contact heat transfer.

10. A device as set forth in claim 9, wherein the roll is heated from the inside thereof with at least one of water, steam, oil, and internal combustion.

11. A device as set forth in claim 3, wherein the belt is conductively heated with an electric current.

12. A device as set forth in claim 1 or 3, wherein the processing device is configured as at least one of a pre-calender upstream of a coating process, a final calender downstream of a paper machine, a final calender downstream of a coating process, an intermediate calender, a dryer, a coater, a pnnter, a press, and a heater for at least one of surface sizing and stock sizing.

13. A device as set forth in claim 1 or 3, wherein the processing zone contact pressure is adjustable by varying a tension of the belt.

14. A device as set forth in claim 13, wherein the guiding elements are displaceable for varying the tension of the belt.

15. A device as set forth in claim 1 or 3, wherein the processing zone length is adjustable by re-positioning the guiding elements.

* * * * *

UNITED STATES PATENT AND TRADEMARK OFFICE

CERTIFICATE OF CORRECTION

PATENT NO. : 7,704,351 B2
APPLICATION NO. : 10/502865
DATED : April 27, 2010
INVENTOR(S) : Lipponen et al.

It is certified that error appears in the above-identified patent and that said Letters Patent is hereby corrected as shown below:

On the Title Page

Item
(75) Inventors: Juha Lipponen, Järvenpää (FI); Vilho Nissinen, Numminen (FI); Pekka Koivukunnas, Järvenpää (FI); Mika Viljanmaa, Helsinki (FI); Henri Vaittinen, Järvenpää (FI); Reijo Pietikäinen, Järvenpää (FI); Kari Hasanen, Kerava (FI); Risto Sutti, Tampere (FI); Eero Suomi, Hameenlinna (FI); Pekka Linnonmaa, Järvenpää (FI); Markku Kyytsönen, Numminen (FI); Matti Tervonen, Hyvinkää (FI); Heikki Kettunen, Espoo (FI); Kari Holopainen, Muurame (FI)" should read Item
--(75) Inventors: Juha Lipponen, Järvenpää (FI); Vilho Nissinen, Numminen (FI); Pekka Koivukunnas, Järvenpää (FI); Mika Viljanmaa, Helsinki (FI); Henri Vaittinen, Järvenpää (FI); Reijo Pietikäinen, Järvenpää (FI); Kari Hasanen, Kerava (FI); Risto Sutti, Tampere (FI); Eero Suomi, Hameenlinna (FI)--

Column 18

Line 8, "pnnter" should read --printer--

Signed and Sealed this
Fourth Day of January, 2011

David J. Kappos

David J. Kappos
*Director of the United States Patent and Trademark Office*